US008421832B2

(12) United States Patent
Higuchi et al.

(10) Patent No.: US 8,421,832 B2
(45) Date of Patent: Apr. 16, 2013

(54) SURFACE PROPERTY MODIFYING SHEET CARTRIDGE AND IMAGE FORMING CARTRIDGE

(76) Inventors: Ken Higuchi, Kanagawa (JP); Hiromi Tsujie, Kanagawa (JP)

( * ) Notice: Subject to any disclaimer, the term of this patent is extended or adjusted under 35 U.S.C. 154(b) by 0 days.

(21) Appl. No.: 13/208,653

(22) Filed: Aug. 12, 2011

(65) Prior Publication Data

US 2012/0044314 A1 Feb. 23, 2012

(30) Foreign Application Priority Data

Aug. 20, 2010 (JP) ..... P2010-185071

(51) Int. Cl.
*B41J 2/32* (2006.01)

(52) U.S. Cl.
USPC ..... 347/214

(58) Field of Classification Search ..... 347/171, 347/172, 174, 176, 214
See application file for complete search history.

(56) References Cited

U.S. PATENT DOCUMENTS

| | | | | |
|---|---|---|---|---|
| 8,149,255 | B2 * | 4/2012 | Higuchi et al. | 347/175 |
| 8,174,549 | B2 * | 5/2012 | Murakami | 347/175 |
| 2009/0035493 | A1 * | 2/2009 | Murakami et al. | 428/32.77 |
| 2009/0185023 | A1 * | 7/2009 | Higuchi et al. | 347/214 |
| 2009/0256899 | A1 * | 10/2009 | Murakami | 347/200 |

FOREIGN PATENT DOCUMENTS

| | | |
|---|---|---|
| JP | 10-305601 | 11/1998 |
| JP | 10-315515 | 12/1998 |
| JP | 2009 166373 | 7/2009 |

* cited by examiner

*Primary Examiner* — Huan Tran
(74) *Attorney, Agent, or Firm* — Sony Corporation

(57) ABSTRACT

A surface property modifying sheet cartridge includes two reels that are disposed in parallel with a predetermined interval, a surface property modifying sheet that is provided in a tensioned state between the two reels in a manner such that end parts thereof are respectively fixed to the two reels and are wound respectively around the two reels, and a case part configured to store the two reels and the surface property modifying sheet. In the surface property modifying sheet cartridge, the case part includes a penetrating part that exposes a part of the surface property modifying sheet positioned between the two reels.

12 Claims, 15 Drawing Sheets

SURFACE PROPERTY MODIFYING SHEET CARTRIDGE AND IMAGE FORMING CARTRIDGE

BACKGROUND

The present technology relates to a surface property modifying sheet cartridge and an image forming cartridge in an image forming apparatus that forms an image on a recording medium and forms a protective layer protecting a surface of the image by using a thermal transfer sheet.

Examples of an image forming apparatus include a sublimation type image forming apparatus that transfers a dye layer of a thermal transfer sheet to a recording medium so as to form an image. In the sublimation type image forming apparatus, a transparent protective layer is formed on an image so as to protect a surface of the image which is formed on a recording medium. Specifically, the protective layer shields an image from gas which causes image degradation, absorbs ultraviolet rays so as to prevent discoloration and fading of an image, prevents a dye or the like forming an image from transferring to plastic goods, prevents image abrasion, and protects an image from sebum, for example. The protective layer is provided to be layered on a base material sheet having a ribbon shape, for example, and is thermally transferred on an image with a thermal head. By this thermal transfer of the protective layer on an image, an image can be protected and further, a recording medium can be prevented from curling.

Further, when the protective layer is thermally transferred with a thermal head, a surface condition of the protective layer which is formed on an image of a recording medium is modified, being able to provide glossiness, a mat tone, and a silky tone. As a method for modifying a surface condition of a protective layer, such method is provided that a surface property modifying sheet having a desired surface property is overlapped on an image, then the image and the sheet are heated and pressed by a thermal head, and thus the protection layer is softened so as to transfer the surface property of the surface property modifying sheet to a surface of the protective layer.

For example, Japanese Unexamined Patent Application Publication No. 10-315515 discloses a technique that a sheet on which ink layers of Y, M, and C and surface property modifying parts are alternately continued in sequence is provided to one ribbon cartridge. Thus, the ink and the surface property modifying parts are provided on a single cartridge. Accordingly, image formation and surface property modification can be performed by one ink cartridge. Further, in Japanese Unexamined Patent Application Publication No. 10-305601 discloses a technique that thermal fusion ink of Y, M, and C are stored in different ink ribbon cartridges respectively and the cartridge necessary for image forming is exchanged and attached to a head so as to form an image. In the method of Japanese Unexamined Patent Application Publication No. 10-305601, a ribbon cartridge storing a surface property modifying sheet is attached to the head after the image formation so as to modify a surface condition.

SUMMARY

However, the surface property modifying part is not worn basically, so that it is enough to provide the surface property modifying part for only one image to perform the surface property modification. However, in the configuration of the ribbon cartridge disclosed in Japanese Unexamined Patent Application Publication No. 10-315515, the surface property modifying parts as many as the number of areas of Y, M, and C are demanded. Therefore, waste of materials and cost rise are inevitable. Further, in the method of Japanese Unexamined Patent Application Publication No. 10-305601, waste of materials does not arise but the mechanism for exchanging the cartridges is complicated and the cost rises disadvantageously.

Accordingly, the applicants of the present technology have proposed that a surface property modifying sheet be formed as a ribbon which includes a modifying region for at least one plane and an opening for printing and can be conveyed bidirectionally, and the surface property modifying sheet be overlapped on an ink ribbon so as to be heated and pressed by a thermal head (Japanese Unexamined Patent Application Publication No. 2009-166373). Accordingly, waste of materials and cost rise can be prevented, but users of an image forming apparatus have further demanded small-sizing of the apparatus and an improvement of a maintenance property.

It is desirable to provide a surface property modifying sheet cartridge and an image forming cartridge that enable small-sizing of an image forming apparatus, can improve a maintenance property, and thus are novel and improved.

According to an embodiment of the present technology, there is provided a surface property modifying sheet cartridge including two reels that are disposed in parallel with a predetermined interval, a surface property modifying sheet that is provided in a tensioned state between the two reels in a manner such that end parts thereof are respectively fixed to the two reels and are wound respectively around the two reels, and a case part configured to store the two reels and the surface property modifying sheet. In the surface property modifying sheet cartridge, the case part includes a penetrating part that exposes a part of the surface property modifying sheet positioned between the two reels.

The surface property modifying sheet may include a surface property modifying part that is heated and pressed by a thermal head in surface property modifying processing, a first intermediate part connecting one of the end parts fixed to one of the reels and one end of the surface property modifying part, and a second intermediate part connecting the other of the end parts fixed to the other of the reels and the other end of the surface property modifying part. A rectangular opening part through which the thermal head passes in printing may be formed on one of the first intermediate part and the second intermediate part, and at least one side, which is approximately orthogonal to a running direction of the surface property modifying sheet, of the opening part may have a shape protruding in the running direction toward an outside of the opening part.

Detection holes by which a conveying state of the surface property modifying sheet is detected may be respectively formed on the first intermediate part and the second intermediate part.

Each of the detection holes may have a shape protruding in the running direction of the surface property modifying sheet.

One of the first intermediate part and the second intermediate part on which the opening part is formed may be wound around one of the reels in a length at least equal to or more than a circumferential length of the reel, in either running state.

The surface property modifying part may be made of a material different from a material of the first intermediate part and the second intermediate part.

The surface property modifying part may be made of polyimide, and the first intermediate part and the second intermediate part may be made of polyethylene terephthalate.

The surface property modifying part may have an approximately same thickness as a thickness of the first intermediate part and the second intermediate part.

A thickness of a connecting part on which the surface property modifying part and the first intermediate part are connected with each other and a thickness of a connecting part on which the surface property modifying part and the second intermediate part are connected with each other may be same as a thickness of a part of the surface property modifying part, the first intermediate part, and the second intermediate part other than the connecting parts.

According to another embodiment of the present technology, there is provided an image forming cartridge includes a thermal transfer sheet cartridge including two reels that are disposed in parallel with a predetermined interval, a thermal transfer sheet that is provided in a tensioned state between the two reels in a manner such that end parts thereof are respectively fixed to the two reels and are wound respectively around the two reels, and includes a plurality of dye layer regions and protective material layer regions, and a case part configured to store the two reels and the thermal transfer sheet, and a surface property modifying sheet cartridge including two reels that are disposed in parallel with a predetermined interval, a surface property modifying sheet that is provided in a tensioned state between the two reels in a manner such that end parts thereof are respectively fixed to the two reels and are wound respectively around the two reels, and a case part configured to store the two reels and the surface property modifying sheet. In the image forming cartridge, the thermal transfer sheet cartridge and the surface property modifying sheet cartridge are detachably provided to each other.

The two reels of the thermal transfer sheet cartridge and the two reels of the surface property modifying sheet cartridge may be provided approximately in parallel, and the surface property modifying sheet cartridge may be provided to the thermal transfer sheet cartridge so that the two reels of the thermal transfer sheet cartridge are interposed between the two reels of the surface property modifying sheet cartridge.

The case part of the surface property modifying sheet cartridge includes an engagement part that is engaged with a protrusion part, which is provided to a printing mechanism including the thermal transfer sheet cartridge, when the surface property modifying sheet cartridge is attached to the printing mechanism.

The case part of the surface property modifying sheet cartridge may include a positioning part that is fitted to a fitting part, which is provided to the printing mechanism including the thermal transfer sheet cartridge, when the surface property modifying sheet cartridge is attached to the printing mechanism.

According to the embodiments of the present technology, the surface property modifying sheet cartridge and the image forming cartridge by which an image forming apparatus can be small-sized and a maintenance property can be improved can be provided.

DETAILED DESCRIPTION OF EMBODIMENTS

Figure 1:
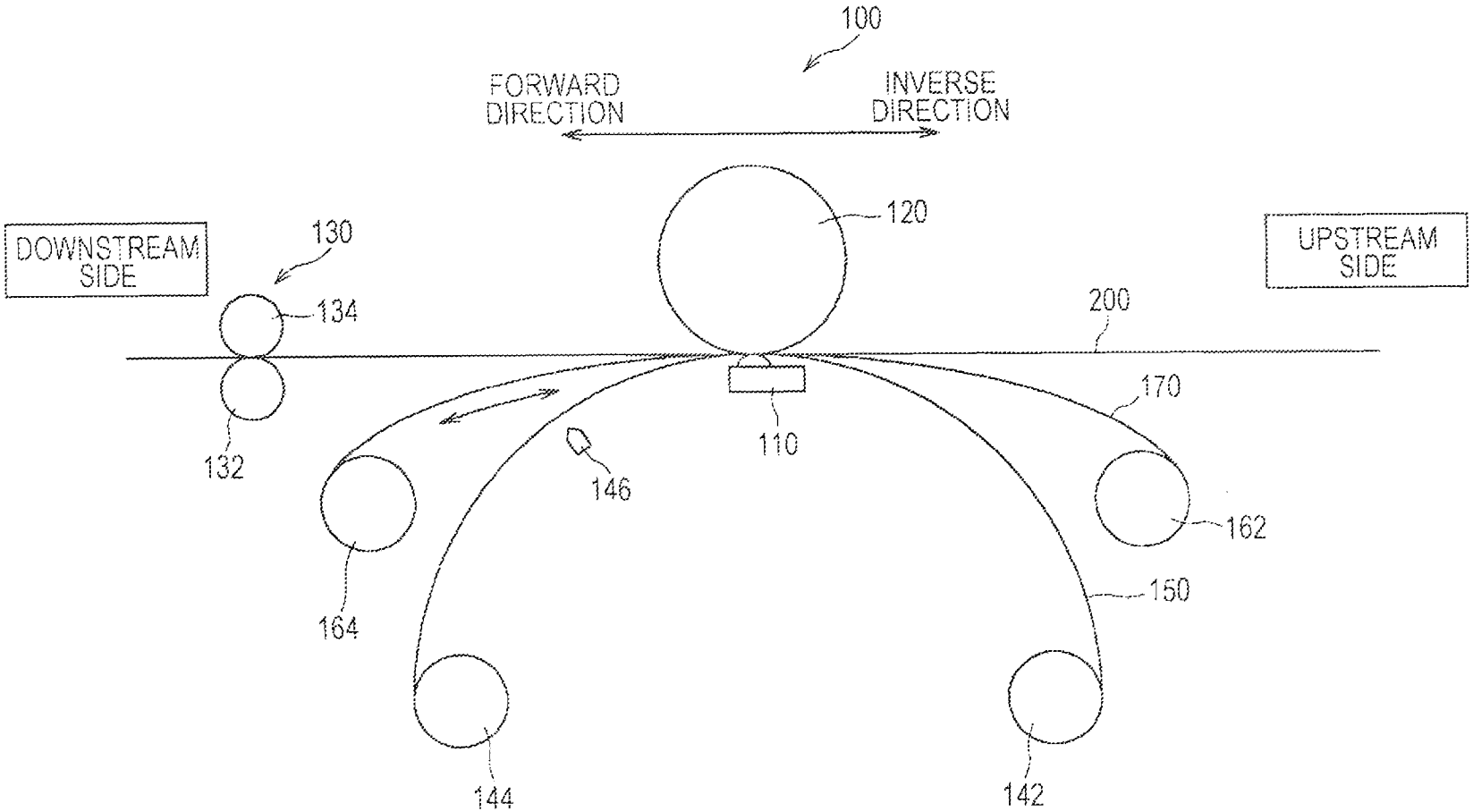
FIG. 1 illustrates the schematic configuration of an image forming apparatus according to an embodiment of the present technology.

Preferred embodiments of the present technology will be described in detail in reference to the accompanying drawings. Here, in this specification and the drawings, configuration elements substantially having the same functional configuration as each other will be given the same reference characters and the description thereof will be skipped.

The description is provided in the following order.

1. Schematic Configuration of Image Forming Apparatus
2. Image Forming Processing
3. Configuration of Surface Property Modifying Sheet Cartridge <1. Schematic Configuration of Image Forming Apparatus>

The schematic configuration of an image forming apparatus according to an embodiment of the present technology is first described with reference to FIG. 1. FIG. 1 illustrates the schematic configuration of the image forming apparatus according to the embodiment of the present technology. The image forming apparatus according to the embodiment is a thermal printer 100 that sublimates a dye of an ink film so as to transfer the dye to a recording medium. The thermal printer 100 forms an image on the recording medium and also forms a protective layer which protects a surface of the image by using a thermal transfer sheet.

The thermal printer 100 includes a thermal head 110, a platen roller 120 which holds a recording paper 200 which is a recording medium, a pinch roller 132, a capstan roller 134, a supply reel 142 and a winding reel 144 for a thermal transfer sheet 150, and a winding reel 162 and a supply reel 164 for a surface property modifying sheet 170, as shown in FIG. 1.

The recording paper 200 is a recording medium on which an image is formed in the thermal printer 100, and may be a sublimation transfer printing paper or the like, for example. The platen roller 120 holds the recording paper 200 in printing and is provided to be opposed to the thermal head 110. The pinch roller 132 and the capstan roller 134 are provided to contact with each other such that the recording paper 200 can be inserted between them. The pinch roller 132 and the capstan roller 134 constitute a conveying unit 130 in which the pinch roller 132 and the capstan roller 134 synchronously rotate in opposite directions to each other so as to convey the recording paper 200 to a predetermined direction and reverse rotating directions thereof so as to convey the recording paper 200 to a direction opposite to the predetermined direction. The platen roller 120, the pinch roller 132, the capstan roller 134, and a roller driving mechanism (not shown) constitute a conveying mechanism which conveys the recording paper 200.

Figure 2:
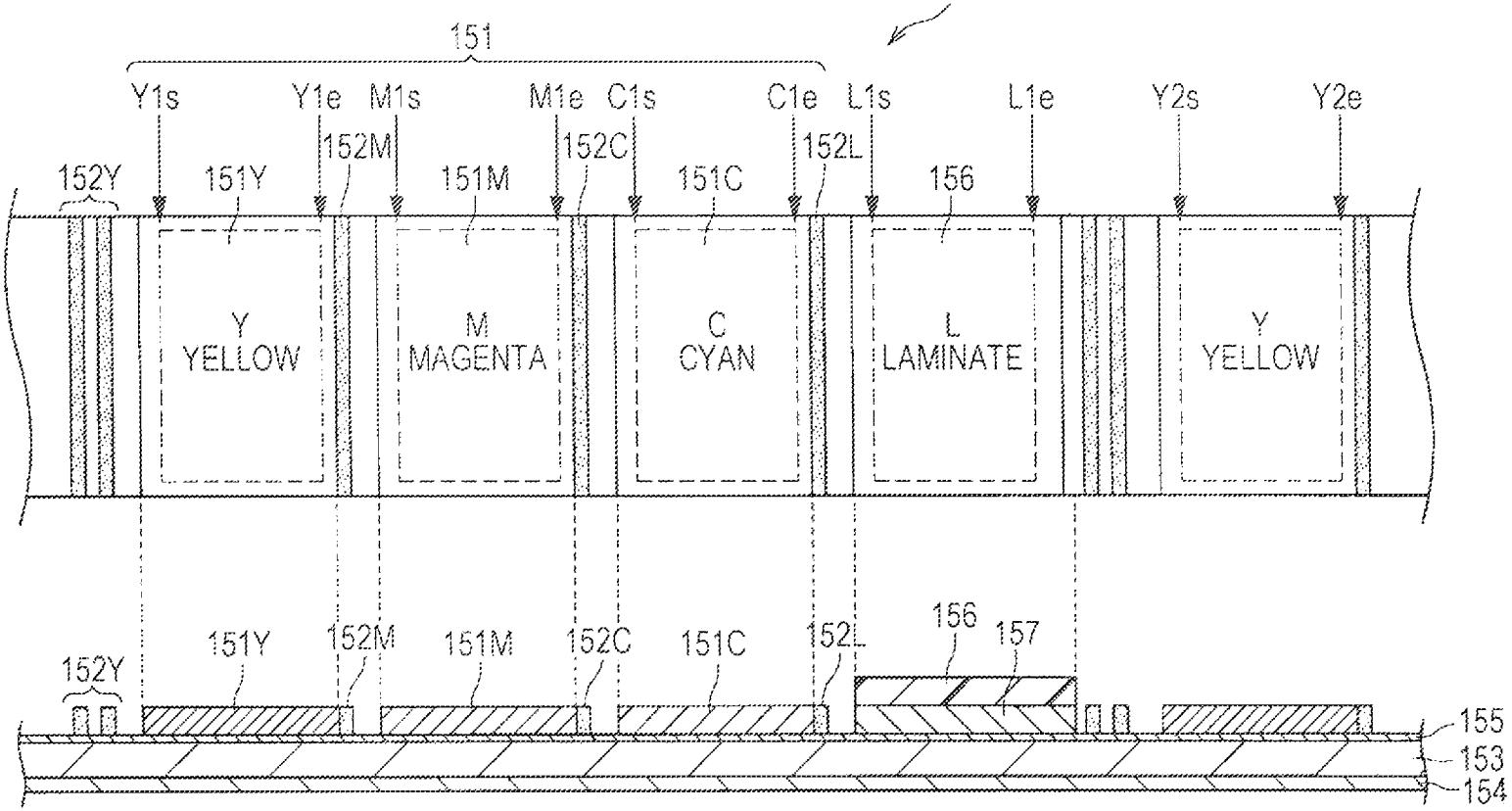
FIG. 2 illustrates the configuration of a thermal transfer sheet according to the embodiment.

The thermal transfer sheet 150 is a sheet holding a dye which is thermally transferred to the recording paper 200 so as to form an image. FIG. 2 shows the detailed configuration of the thermal transfer sheet 150. In the thermal transfer sheet 150, a dye layer 151 holding a dye, and a protective material layer 156 which is thermally transferred to a surface of an image formed on a surface of the recording paper 200 so as to protect the image are formed on a base material sheet 153 having a ribbon shape in a manner to be aligned in a longitudinal direction of the base material sheet 153. This thermal transfer sheet 150 is commonly called an ink ribbon. A heat-resistant lubricating layer 154 is formed on a back surface of the base material sheet 153 and an easy-adhesion layer 155 is formed on a front surface of the base material sheet 153.

The dye layer 151 holds a single dye or a plurality of dyes. In this embodiment, the dye layer 151 holds dyes of three colors, that is, a yellow (Y) dye layer 151Y, a magenta (M) dye layer 151M, and a cyan (C) dye layer 151C. As well as these, the dye layer 151 may include a black dye layer, for example. In FIG. 2, a front end position and a rear end position of the yellow dye layer 151Y are respectively denoted as Y1*s* and Y1*e*, a front end position and a rear end position of the magenta dye layer 151M are respectively denoted as M1*s* and M1*e*, and a front end position and a rear end position of the cyan dye layer 151C are respectively denoted as C1*s* and C1*e*. The dye layer 151 is formed on the base material sheet 153 with the easy-adhesion layer 155 interposed as shown in FIG. 2, and is transferred to a surface of the recording paper 200 by sublimation transfer or melt transfer.

The protective material layer 156 is formed on the easy-adhesion layer 155, which is formed on the front surface side of the base material sheet 153, with a peel-off layer 157 further interposed. In FIG. 2, a front end position and a rear end position of the protective material layer 156 are respectively denoted as L1*s* and L1*e*. The protective material layer 156 is transferred to the surface of the recording paper 200 so as to enhance abrasion resistance, chemical resistance, and the like of an image formed on the surface of the recording paper 200. Further, if ultraviolet absorber is added on the protective material layer 156, light resistance of the image also can be enhanced. The protective material layer 156 may be made of thermoplastic resin such as polystyrene resin, for example. Alternatively, an adhesive layer (not shown) may be provided on the uppermost layer of the protective material layer 156 so as to improve adhesiveness of the protective material layer 156 with respect to the recording paper 200 and the surface of an image formed on the surface of the recording paper 200. For example, the protective material layer 156 may be formed to have a two-layer structure in which acrylic modified resin is provided on an upper layer of polystyrene resin.

On the thermal transfer sheet 150, a plurality of unit regions composed of four regions are provided. The four regions of the unit region are the respective dye layers which are the yellow dye layer 151Y, the magenta dye layer 151M, and the cyan dye layer 151C, and the protective material layer 156. On heads of the yellow dye layer 151Y, the magenta dye layer 151M, the cyan dye layer 151C, and the protective material layer 156 of each of the unit regions, position detecting marks 152Y, 152M, 152C, and 152L which express head positions of respective regions are respectively provided. The position detecting marks 152Y, 152M, 152C, and 152L are linear markings which are formed across the base material sheet 153 in the width direction. Here, the position detecting mark 152Y of the yellow dye layer 151Y which is provided on the head of each of the unit regions is composed of two lines, while each of the position detecting marks 152M, 152C, and 152L of the magenta dye layer 151M, the cyan dye layer 151C, and the protective material layer 156 is composed of one line.

Such thermal transfer sheet 150 is stored in a ribbon cassette (not shown) in a manner to be provided in a tensioned state between the supply reel 142 and the winding reel 144 as shown in FIG. 1. The ribbon cassette is detachably provided to an image forming apparatus body. When the ribbon cassette is attached to the image forming apparatus body, the thermal transfer sheet 150 is run in synchronization with conveyance of the recording paper 200 in a manner to be sandwiched by the thermal head 110 and the platen roller 120. The supply reel 142 and the winding reel 144 constitute a thermal transfer sheet running mechanism for running the thermal transfer sheet 150 in a predetermined direction. The thermal transfer sheet 150, the supply reel 142, and the winding reel 144 are not necessarily stored in the ribbon cassette, but they may be respectively provided to predetermined positions of the image forming apparatus body so as to be driven.

On the way of a running path of the thermal transfer sheet 150 run by the thermal transfer sheet running mechanism, an optical sensor 146 is provided. The optical sensor 146 detects the position detecting marks 152Y, 152M, 152C, and 152L formed on the thermal transfer sheet 150. Based on a detecting result of the optical sensor 146, the dye layer of the color which is to be transferred to the recording paper 200 is set on a transfer position. Therefore, the optical sensor 146 is provided on a position apart from a position, on which the thermal head 110 and the platen roller 120 are opposed to each other, by a predetermined distance so that when the optical sensor 146 detects each of the position detecting marks 152Y, 152M, 152C, and 152L, corresponding dye layer 151Y, 151M, or 151C or the protective material layer 156 is positioned on a transfer position.

Figure 3:
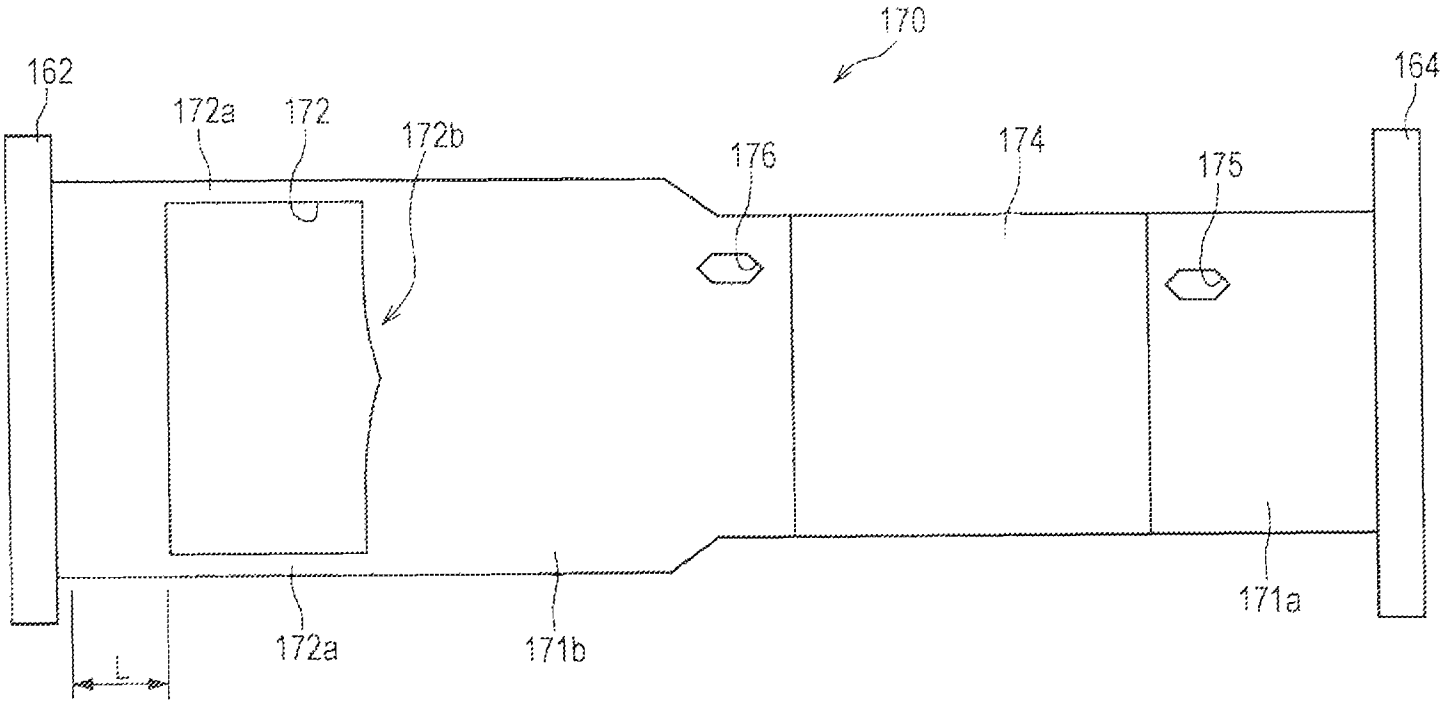
FIG. 3 illustrates the configuration of a surface property modifying sheet according to the embodiment.

The surface property modifying sheet 170 is a ribbon-shaped sheet serving as a surface property modifying member which modifies a surface condition of a protective layer protecting an image which is formed on the recording paper 200. The surface property modifying sheet 170 is composed of leader sheets 171*a* and 171*b*, and a property modifying sheet 174 which is provided between the leader sheets 171*a* and 171*b* as shown in FIG. 3.

The leader sheets 171*a* and 171*b* are provided so as to perform positioning of the surface property modifying sheet 170 and have large tensile strength. End parts of the leader sheets 171*a* and 171*b* are respectively fixed to the supply reel 164 and the winding reel 162. The leader sheets 171*a* and 171*b* are made of polyethylene terephthalate (PET), for example.

The first leader sheet 171*a* is fixed to the supply reel 164 and includes a processing starting position detecting hole 175. The processing starting position detecting hole 175 is used for detecting a start of heating processing for sublimating a dye of the thermal transfer sheet 150 which is performed by the thermal head 110. The position detection using the processing starting position detecting hole 175 is performed by a sensor actuator shown in FIGS. 4A to 4C. The sensor actuator includes a supporting part 190 which is rotatably provided around a rotating shaft 190*a* and a roller part 192 of which a supporting shaft 192*a* is fit in a cutout part 190*b* of the supporting part 190 and which is placed on the surface property modifying sheet 170. The roller part 192 is driven and rotated in response to movement of the surface property modifying sheet 170 so as not to damage a surface of the surface property modifying sheet 170.

Figures 4A, 4B, 4C:
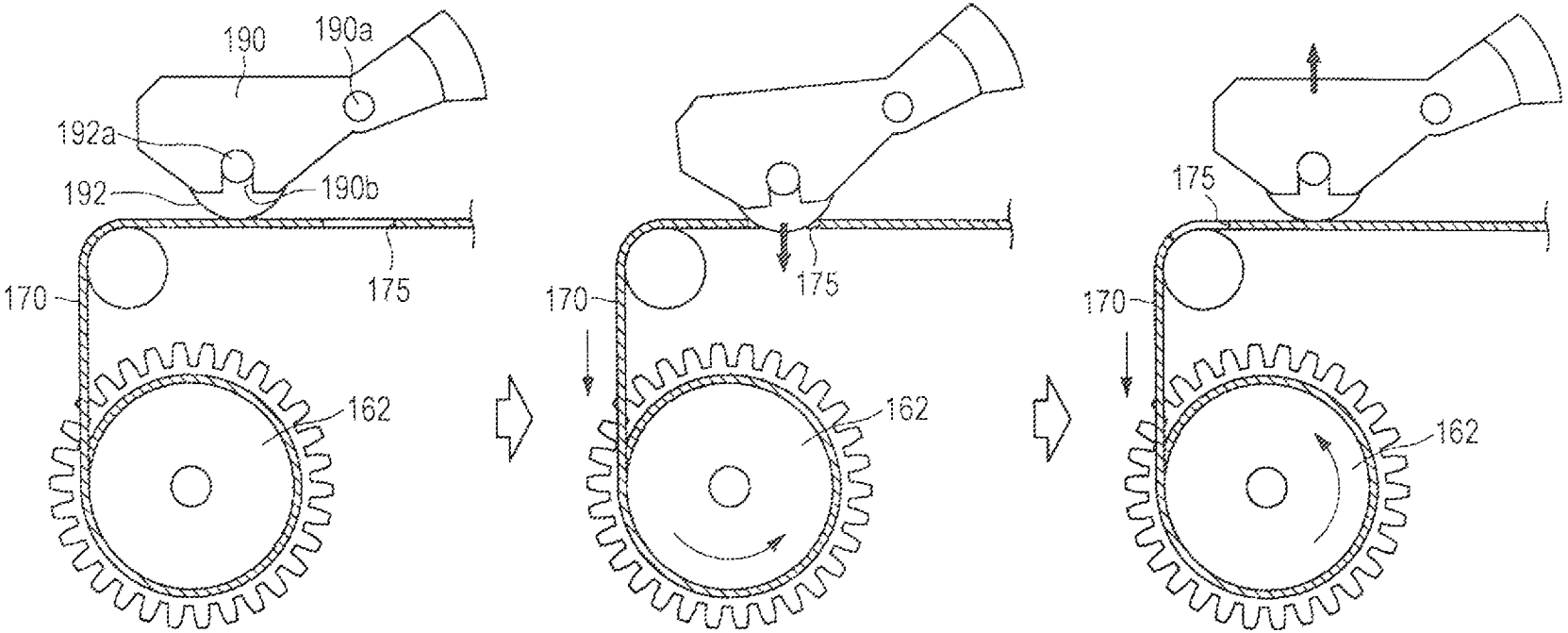
FIGS. 4A to 4C illustrate position detection performed by a sensor actuator.

The roller part 192 is usually positioned on the surface property modifying sheet 170 as shown in FIG. 4A. However, when the surface property modifying sheet 170 is moved and heating processing is requested, the roller part 192 falls down to be set in the processing starting position detecting hole 175 as shown in FIG. 4B. When the sensor actuator detects the movement of the roller part 192 in the gravity direction, the sensor actuator detects the start of the heating processing. When the surface property modifying sheet 170 is further moved from the state of FIG. 4B, the roller part 192 is returned to be positioned on the surface property modifying sheet 170 again as shown in FIG. 4C.

The processing starting position detecting hole 175 may be formed to be slanted in a moving direction of the surface property modifying sheet 170 so as to reduce catching with respect to the roller part 192 of the sensor actuator. The processing starting position detecting hole 175 of the embodiment is formed to have an approximate hexagonal shape as shown in FIG. 3. However, embodiments of the present technology are not limited to this example, and the processing starting position detecting hole 175 may have a rhomboid shape or the like, for example. Accordingly, the roller part 192 can easily set in the processing starting position detecting hole 175 and easily come out from the processing starting position detecting hole 175. Thus, the processing starting position detecting hole 175 repeatedly receives a load from the roller part 192, so that the surface property modifying sheet 170 should be made of a material sustainable to this load.

The second leader sheet 171*b* is fixed to the winding reel 162 and includes an opening part 172 which is formed to let the thermal head 110 go therethrough and a storing position detecting hole 176.

Figure 7:
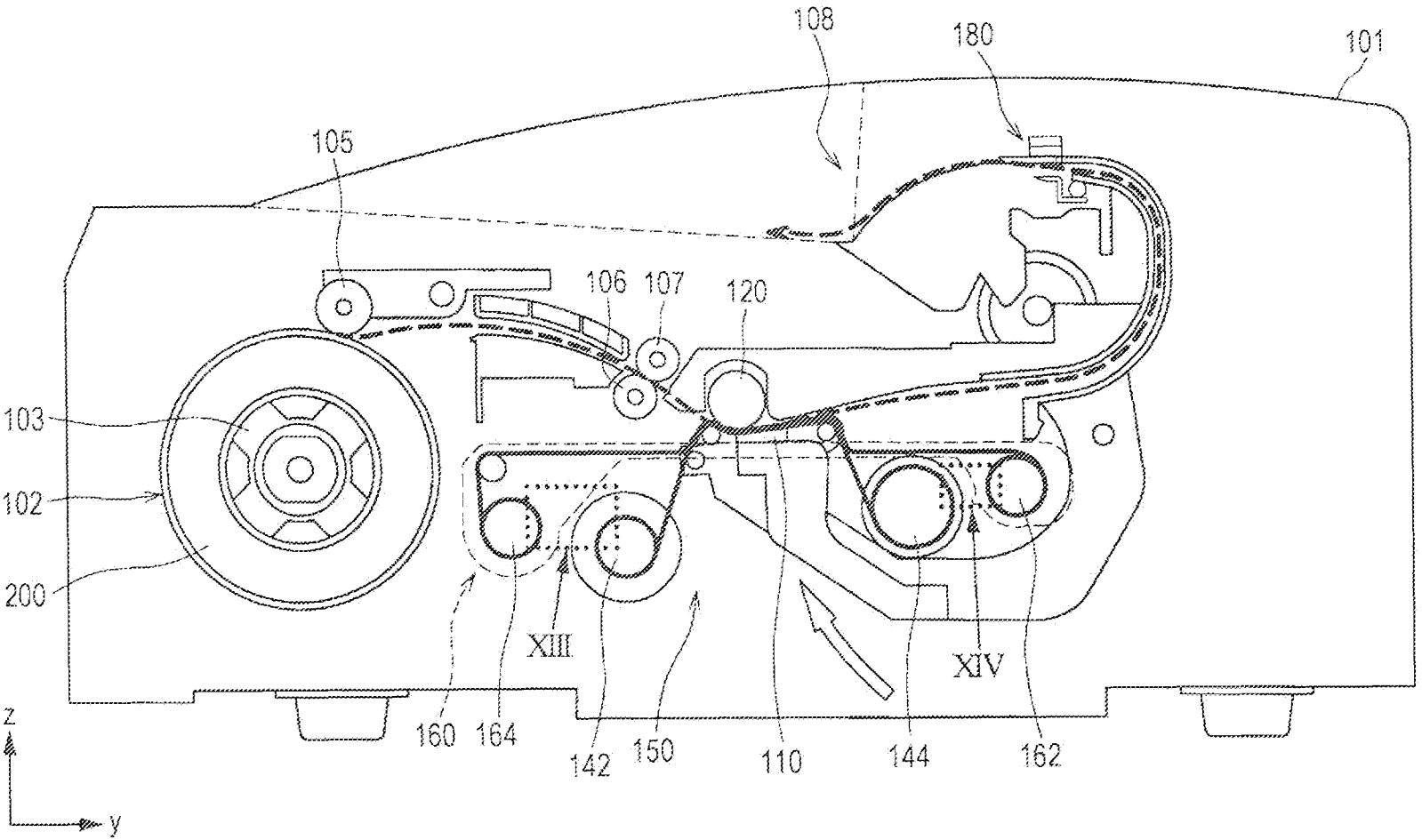
FIG. 7 illustrates a state of the thermal transfer sheet and the surface property modifying sheet stored in the surface property modifying sheet cartridge in the surface property modifying processing.

The opening part 172 is formed to be used such that the thermal head 110 is permitted to pass through the opening part 172 so as to be pressed on the thermal transfer sheet 150 when a dye is transferred to the recording paper 200 by the thermal transfer sheet 150 (refer to FIG. 7). The opening part 172 is formed to have the width which is slightly larger than the length of the thermal head 110 in a main scanning direction (a vertical direction of the sheet of FIG. 3). In normal printing and normal protective layer forming, the thermal head 110 is pressed on a printing paper with the thermal transfer sheet 150 interposed. Thus, a normal printing operation, in which an image is formed with the thermal head 110 while moving the printing paper and the thermal transfer sheet and the protective layer is further formed on the image, can be performed.

On the position on which the opening part 172 is formed, the leader sheet 171*b* is left only on side parts 172*a* which are both end parts of the surface property modifying sheet 170 in the width direction (a direction orthogonal to the running direction). The side parts 172*a* have a propensity to shift inward when a tensile force is applied due to running of the surface property modifying sheet 170. If the surface property modifying sheet 170 is run in this state, the side parts 172*a* are caught at an entering/leaving gap for a surface property modifying sheet cartridge in which the surface property modifying sheet 170 is stored.

Accordingly, the second leader sheet 171*b* is wound around the winding reel 162 in one or more turn so as to surely make the side parts of the opening part 172 parallel to each other. That is, as shown in FIG. 3, a length L from the position on which the second leader sheet 171*b* is fixed to the winding reel 162 to one side, which is on the winding reel 162 side, of the opening part 172 is set to be at least equal to or more than the circumferential length of the winding reel 162. Accordingly, the surface property modifying sheet 170 can be run stably. Further, by providing a regulation member which determines inner regulating positions against the force that the side parts 172*a* of the opening part 172 shift to the inside of the surface property modifying sheet 170, the side parts 172*a* can securely be made parallel to each other. Details of the regulation member will be described later.

The leader sheet 171 is thin so as to be easily bent. Accordingly, the opening part 172 tends to be caught at the entering/leaving gap when the surface property modifying sheet 170 is pulled out of the surface property modifying sheet cartridge in which the surface property modifying sheet 170 is stored. Therefore, in this embodiment, at least one side, which is orthogonal to the running direction, of the opening part 172 is formed to be protruded toward the outside of the opening part 172 in the running direction of the surface property modifying sheet 170 (reference character 172*b*), as shown in FIG. 3. Accordingly, the surface property modifying sheet 170 can be prevented from being caught at the entering/leaving gap of the surface property modifying sheet cartridge.

In this embodiment, only one side, which is positioned on the property modifying sheet 174 side, of the opening part 172 is formed to be protruded in the running direction, but embodiments of the present technology are not limited to this example. A side which is positioned on the winding reel 162 side may be formed to be protruded in the running direction, as well. In the configuration of the embodiment, the second leader sheet 171*b* is wound around the winding reel 162 in one or more turn, so that one side on the winding reel 162 side is pulled out from the winding reel 162 only in small measure. Accordingly, it is sufficient that at least one side, which is on the property modifying sheet 174 side, of the opening part 172 is formed to be protruded in the running direction.

The storing position detecting hole 176 is used for detecting a state that the surface property modifying sheet 170 is wound around the supply reel 164 and stored. The position detection by the storing position detecting hole 176 is performed by the sensor actuator shown in FIGS. 4A to 4C as is the case with the position detection by the processing starting position detecting hole 175. That is, when the surface property modifying sheet 170 is moved and stored in the supply reel 164, the roller part 192 positioned on the surface property modifying sheet 170 falls down to set in the storing position detecting hole 176. The sensor actuator detects the movement of the roller part 192 in the gravity direction to detect that the surface property modifying sheet 170 is stored in the supply reel 164. When such state is detected, the movement of the surface property modifying sheet 170 is stopped.

The property modifying sheet 174 is a member used for performing surface property modifying processing and is a sheet made of a material corresponding to a surface finish. In the embodiment, the property modifying sheet 174 for performing mirror-finish processing by which glossiness is imparted to a protective layer surface of a printing object is provided. The property modifying sheet 174 for performing mirror-finish processing may be a polyimide film of which a surface is extremely flat, for example. Specifically, the property modifying sheet 174 may be UPILEX®-S, Kapton®, or the like. Other than these, the property modifying sheet 174 may be made of polysulfone, polyetherimide, polyethylene terephthalate, or the like, for example.

The protective layer is firmly attached to the property modifying sheet 174 in an moderately soften manner in the surface property modifying processing, so that the surface condition of the protective layer becomes flat by following the surface condition of the property modifying sheet 174. Then, the heating processing by the thermal head 110 is finished, and the thermal head 110 is separated from the property modifying sheet 174. Subsequently, the recording paper 200 is peeled off from the property modifying sheet 174 after the protective layer cools down. Thus, the flat surface of the property modifying sheet 174 is transferred to the protective layer. Accordingly, the protective layer surface of the printing object is finished to be extremely flat and glossy.

Here, a polyimide film has lower adhesiveness with respect to the protective layer than the property modifying sheet 174 made of other materials. The property modifying sheet 174 made of other materials is firmly attached to adhere to the protective layer even in a state that the protective layer which is a thermoplastic resin is softened to some extent, and accordingly, cohesive failure disadvantageously occurs within the protective layer. Consequently, a peeling-off defect occurs when the property modifying sheet 174 and the protective layer are peeled off from each other after the surface property modifying processing, and therefore the protective layer surface may obtain insufficient gloss. Therefore, the polyimide film is used as the property modifying sheet 174 in the embodiment. Accordingly, the occurrence of the peeling-off defect caused by the occurrence of the cohesive failure inside the protective layer can be prevented and therefore favorable glossiness can be imparted to the protective layer surface of the printing object.

Here, on connecting parts between the leader sheet 171*a* and the property modifying sheet 174 and between the leader sheet 171*b* and the property modifying sheet 174, respective sheets are superposed on each other. Therefore, the thickness of the connecting part and the thickness of other part are different from each other. If a step is formed on the connecting part of the sheets, the surface property modifying sheet 170 may be caught at the entering/leaving gap (reference characters 161*d* and 161*e* of FIG. 9, for example) or the like of the surface property modifying sheet cartridge. Therefore, it is preferable to minimize the step on the connecting part.

In the embodiment of the present technology, the thicknesses of parts, which are to be on the connecting parts, of the leader sheets 171*a* and 171*b* and the property modifying sheet 174 are set to be smaller than the thicknesses of other parts so that the thicknesses of the connecting parts are approximately same as those of parts other than the connecting parts. On the connecting parts, respective sheets may be connected with a tape, for example. Accordingly, the whole of the surface property modifying sheet 170 has an approximately even thickness, and thereby the surface property modifying sheet 170 can be prevented from being caught at the entering/leaving gap of the surface property modifying sheet cartridge.

<2. Image Forming Processing>

Figure 5A:
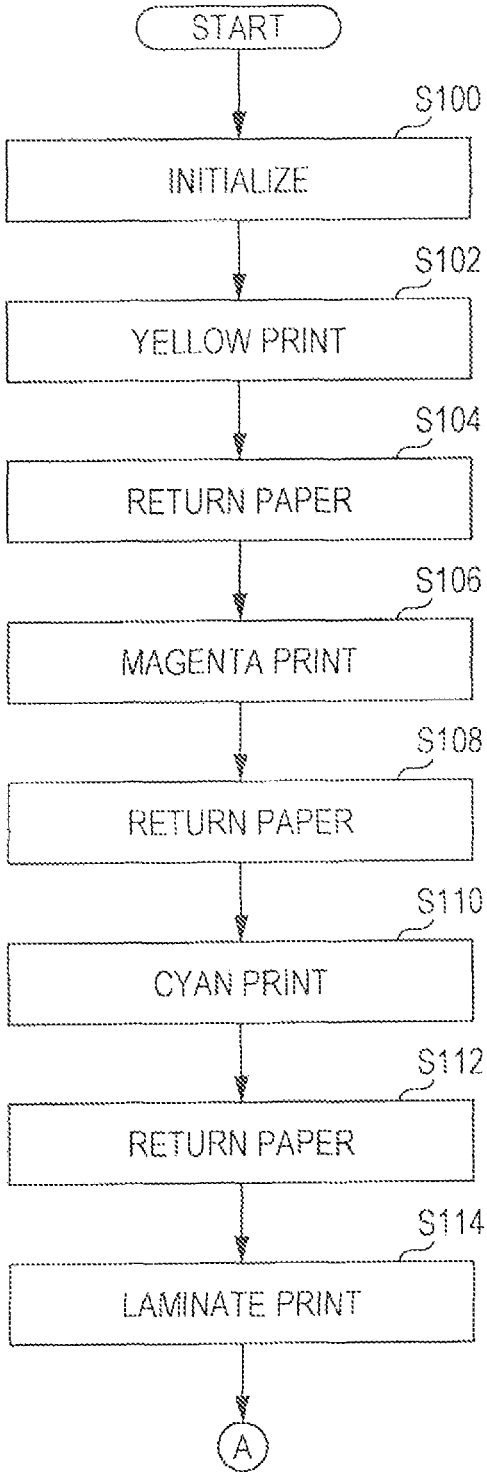
FIG. 5A is a flowchart showing image forming processing performed by the image forming apparatus according to the embodiment.
Figure 5B:
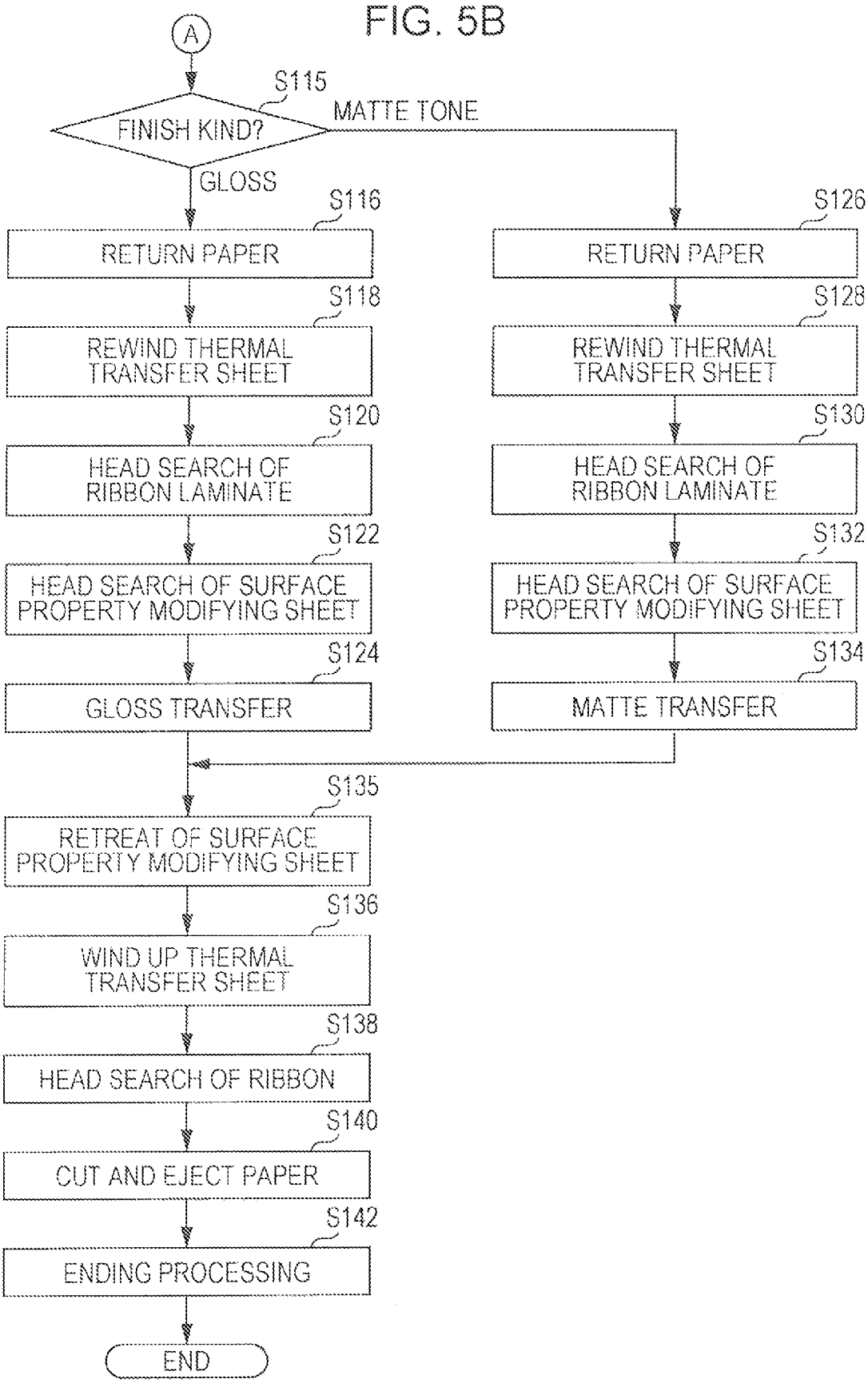
FIG. 5B is a flowchart showing image forming processing performed by the image forming apparatus according to the embodiment.

In the image forming apparatus described above, an image is formed on the recording paper 200 through processing shown in FIGS. 5A and 5B. Image forming processing performed by the image forming apparatus according to the embodiment of the present technology will be described below with reference to FIGS. 5A and 5B. FIGS. 5A and 5B are flowcharts showing the image forming processing performed by the image forming apparatus according to the embodiment.

The image forming processing performed by the image forming apparatus of the embodiment is classified broadly into image forming processing (S100 to S114) using the thermal transfer sheet 150 and surface property modifying processing (S115 to S134) of an image which is formed. When data of an image which is to be formed on the recording paper 200 is inputted into the image forming apparatus, a control unit (not shown) of the image forming apparatus conveys the recording paper 200 in a predetermined direction and moves the thermal head 110, the thermal transfer sheet 150, and the surface property modifying sheet 170 to initial positions respectively (S100). The recording paper 200 is conveyed in the predetermined direction when the platen roller 120, the pinch roller 132, and the capstan roller 134 are driven by a roller driving mechanism (not shown). In the initial state, the surface property modifying sheet 170 is run by a surface property modifying sheet running mechanism which is composed of the winding reel 162 and the supply reel 164, so as to be moved so that the opening part 172 is positioned on a pressing position of the thermal head 110 with respect to the thermal transfer sheet 150.

Subsequently, the thermal transfer sheet 150 is moved by a thermal transfer sheet running mechanism which is composed of the supply reel 142 and the winding reel 144 for the thermal transfer sheet 150. Accordingly, one of regions of the dye layers 151Y, 151M and 151C of the thermal transfer sheet 150 shown in FIG. 2 is positioned on a position on which an image is to be formed with respect to the recording paper 200. Positioning of the thermal transfer sheet 150 can be performed based on a detecting result of a sensor (not shown) which can detect the position detecting marks 152Y, 152M, and 152C formed on the thermal transfer sheet 150.

In the embodiment, three dye layers 151Y, 151M and 151C of yellow (Y), magenta (M), and cyan (C) are formed on the thermal transfer sheet 150. For example, in a state that the yellow dye layer 151Y is first moved to the image forming position by the thermal transfer sheet running mechanism, the thermal head 110 is pressed on the platen roller 120 with the thermal transfer sheet 150 interposed. In this state, thermal energy is applied to the thermal transfer sheet 150 by the thermal head 110 so as to thermally transfer the yellow dye layer 151Y of the thermal transfer sheet 150 to the surface of the recording paper 200, thus forming a yellow image (S102). After that, the recording paper 200 is returned to the initial position by the pinch roller 132 and the capstan roller 134 so as to form an image of the next color (S104).

Next, as is the case with the formation of the yellow image, after the magenta dye layer 151M is moved to the image forming position and a magenta image is formed on the surface of the recording paper 200 (S106), the recording paper 200 is returned to the initial position again (S108). Then, after the cyan dye layer 151C is moved to the image forming position and a cyan image is formed on the surface of the recording paper 200 (S110), the recording paper 200 is returned to the initial position again (S112). Accordingly, an image is formed on the recording paper 200 by the desired dye layers 151Y, 151M, and 151C.

Subsequently, in a state that the image formed on the recording paper 200 is faced to the protective material layer 156 of the thermal transfer sheet 150, the thermal head 110 is pressed on the platen roller 120 with the thermal transfer sheet 150 interposed. In this state, thermal energy is applied to the thermal transfer sheet 150 by the thermal head 110 so as to thermally transfer the protective material layer 156 of the thermal transfer sheet 150 on the image formed on the recording paper 200 (S114). At this time, the thermal transfer sheet 150 is run by the thermal transfer sheet running mechanism. Then, the sensor (not shown) detects the position detecting mark 152L expressing the position of the protective material layer 156 and thus recognizes the position of the thermal transfer sheet 150. Accordingly, the protective material layer 156 of the thermal transfer sheet 150 can be positioned on the image forming position.

When the protective material layer 156 is transferred to the surface of the recording paper 200, the surface condition of a protective layer formed on the surface of the image is not modified yet. Therefore, the protective layer is modified through processing of steps S115 to S134 so as to have the surface condition which is specified by a user. First, the control unit confirms a finish kind of the surface condition which is specified by the user (S115). In the processing procedure shown in FIG. 5B, either glossy finish or matte-tone finish can be selected for the surface condition. This selection is determined by a kind of a surface property modifying part provided on the surface property modifying sheet 170. For example, when only the property modifying sheet 174 for performing the glossy finish is provided as the surface property modifying sheet 170 of the embodiment, only glossy finish processing (S116 to S124) becomes practicable.

In a case where the glossy finish processing is specified, the recording paper 200 is first run to the initial position (S116) and the thermal transfer sheet 150 is rewound (S118). At this time, the thermal transfer sheet 150 is rewound to a position on which the thermal transfer sheet 150 is positioned before the protective material layer 156 is transferred to the recording paper 200, that is, the front end position L1*s* (S120). After that, the surface property modifying sheet 170 is run by the winding reel 162 and the supply reel 164 so as to position a range from the opening part 172 to the property modifying sheet 174 on the image forming position (S122). After the protective layer which is formed on the image of the recording paper 200 and the property modifying sheet 174 of the surface property modifying sheet 170 are aligned as this, these are heated while being pressed by the thermal head 110. Then, when the property modifying sheet 174 is peeled off from the recording paper 200 after cooling down, a flat plane of the property modifying sheet 174 is transferred to the protective layer and thereby glossiness is imparted to the image surface (S124).

In a case where the matte-tone finish processing is specified in step S115 as well, the recording paper 200 is first run to the initial position (S126) and the thermal transfer sheet 150 is rewound (S128). At this time, the thermal transfer sheet 150 is rewound to the position on which the thermal transfer sheet 150 is positioned before the protective material layer 156 is transferred to the recording paper 200, that is, the front end position L1*s* (S130). After that, the surface property modifying sheet 170 is run by the winding reel 162 and the supply reel 164 so as to position a range from the opening part 172 to the surface property modifying part for performing the matte-tone finish on the image forming position (S132). After the protective layer which is formed on the image of the recording paper 200 and the surface property modifying part for performing the matte-tone finish of the surface property modifying sheet 170 are aligned as this, these are heated while being pressed by the thermal head 110. Then, when the surface property modifying part is peeled off from the recording paper 200 after cooling down, the transfer to the protective layer is performed and thereby the image surface obtains a matte tone (S134).

Surface property modifying processing by other kind of surface property modifying part can be performed in a similar manner to steps S116 to S134. When the surface property modifying processing of the image is finished, the thermal transfer sheet 150, the surface property modifying sheet 170, and the recording paper 200 are moved to the downstream side of the conveying direction along with the rotation of the platen roller 120 so as to be separated from the thermal head 110. Then, after temperatures of the thermal transfer sheet 150, the surface property modifying sheet 170, and the recording paper 200 become to have approximately equal to or lower than a predetermined value and thus cool down, the surface property modifying sheet 170 is separated from the recording paper 200.

Subsequently, after the surface property modifying sheet 170 is moved and the property modifying sheet 174 is retreated so as to position the opening part 172 on the image forming position (S135), the thermal transfer sheet 150 is rolled up by the supply reel 142 and the winding reel 144 so as to wind up the dye layer 151 and the protective material layer 156 which are used to the winding reel 144 (S136). Then, the dye layer 151 for forming an image on the next recording paper 200 and the protective material layer 156 are supplied from the supply reel 142 so as to be run to an initial position (S138). On the other hand, after being cut into a predetermined size by a cutting unit (reference character 180 in FIGS. 6 and 7), the recording paper 200 is ejected from an outlet of the image forming apparatus (S140). Subsequently, ending processing is performed (S142), ending the image forming processing performed by the image forming apparatus according to the embodiment of the present technology.

Even in a case where a plurality of images are printed and surface finish conditions of respective printing object are different from each other, specified surface finish conditions can be realized by repeatedly performing the processing of FIGS. 5A and 5B for every printing object.

<3. Configuration of Surface Property Modifying Sheet Cartridge>

In the image forming apparatus according to the embodiment of the present technology, the surface property modifying sheet 170 is integrated with a ribbon tray storing the thermal transfer sheet 150 and a driving source is disposed outside the surface property modifying sheet cartridge. Accordingly, the surface property modifying sheet 170 can be easily attached to and detached from the image forming apparatus body, small-sizing of the apparatus can be realized, and a maintenance property can be improved. The configuration of the surface property modifying sheet cartridge according to the embodiment of the present technology is described in detail with reference to FIGS. 6 to 15B.

[Arrangement of Surface Property Modifying Sheet Cartridge in Image Forming Apparatus]

Figure 6:
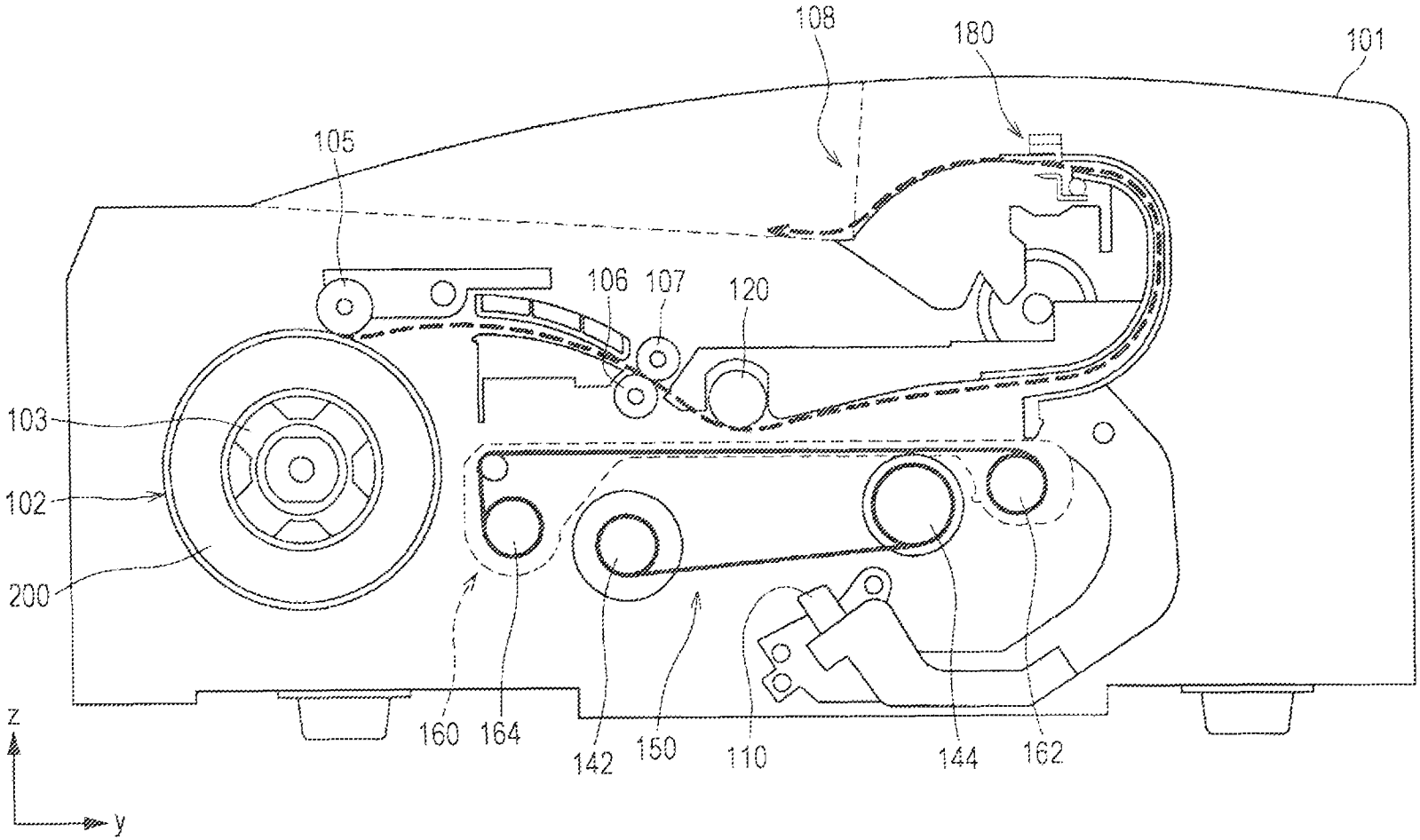
FIG. 6 illustrates a state that the thermal transfer sheet and the surface property modifying sheet stored in a surface property modifying sheet cartridge are run.

An arrangement of a surface property modifying sheet cartridge 160 and the thermal transfer sheet 150 in the image forming apparatus according to the embodiment is shown in FIGS. 6 and 7.

FIG. 6 illustrates a state running the thermal transfer sheet 150 and the surface property modifying sheet 170 which is stored in the surface property modifying sheet cartridge 160. Running paths of the thermal transfer sheet 150 and the surface property modifying sheet 170 are separated from each other so as to prevent the respective sheets from affecting each other in an operation of positioning (running) of respective sheets. The state shown in FIG. 6 is also a state when the surface property modifying sheet cartridge 160 is attached to and detached from the ribbon tray.

On the other hand, at the time of surface property modifying processing, the thermal head 110 is raised from a waiting position so as to sandwich the recording paper 200, the surface property modifying sheet 170, and the thermal transfer sheet 150 together with the platen roller 120, as shown in FIG. 7. Thus, in the state the recording paper 200, the surface property modifying sheet 170, and the thermal transfer sheet 150 are pressed, they are conveyed while being heated. Thus the surface property modifying processing is performed.

It is necessary to convey the thermal transfer sheet 150 and the surface property modifying sheet 170 approximately in parallel in the surface property modifying processing. When an angle is generated in the conveying direction, the angle causes a crinkle and the like occurring in each of the sheets 150 and 170 and the recording paper 200, degrading the quality level of a surface texture. Therefore, it is necessary to dispose four reels which are the supply reel 142 and the winding reel 144 for the thermal transfer sheet 150 and the winding reel 162 and the supply reel 164 for the surface property modifying sheet 170 in parallel. Therefore, a positioning part for positioning these reels 142, 144, 162, and 164 is formed on the surface property modifying sheet cartridge. Further, in order to prevent parallelism of each of the reels 142, 144, 162, and 164 from destroying due to an application of a driving force in the surface property modifying processing, a fixing mechanism is provided to the surface property modifying sheet cartridge. Furthermore, a regulation member is provided so as to prevent the side parts 172*a* of the opening part 172 of the second leader sheet 171*b* of the surface property modifying sheet 170 from shifting inward due to a tensile force.

Figure 8:
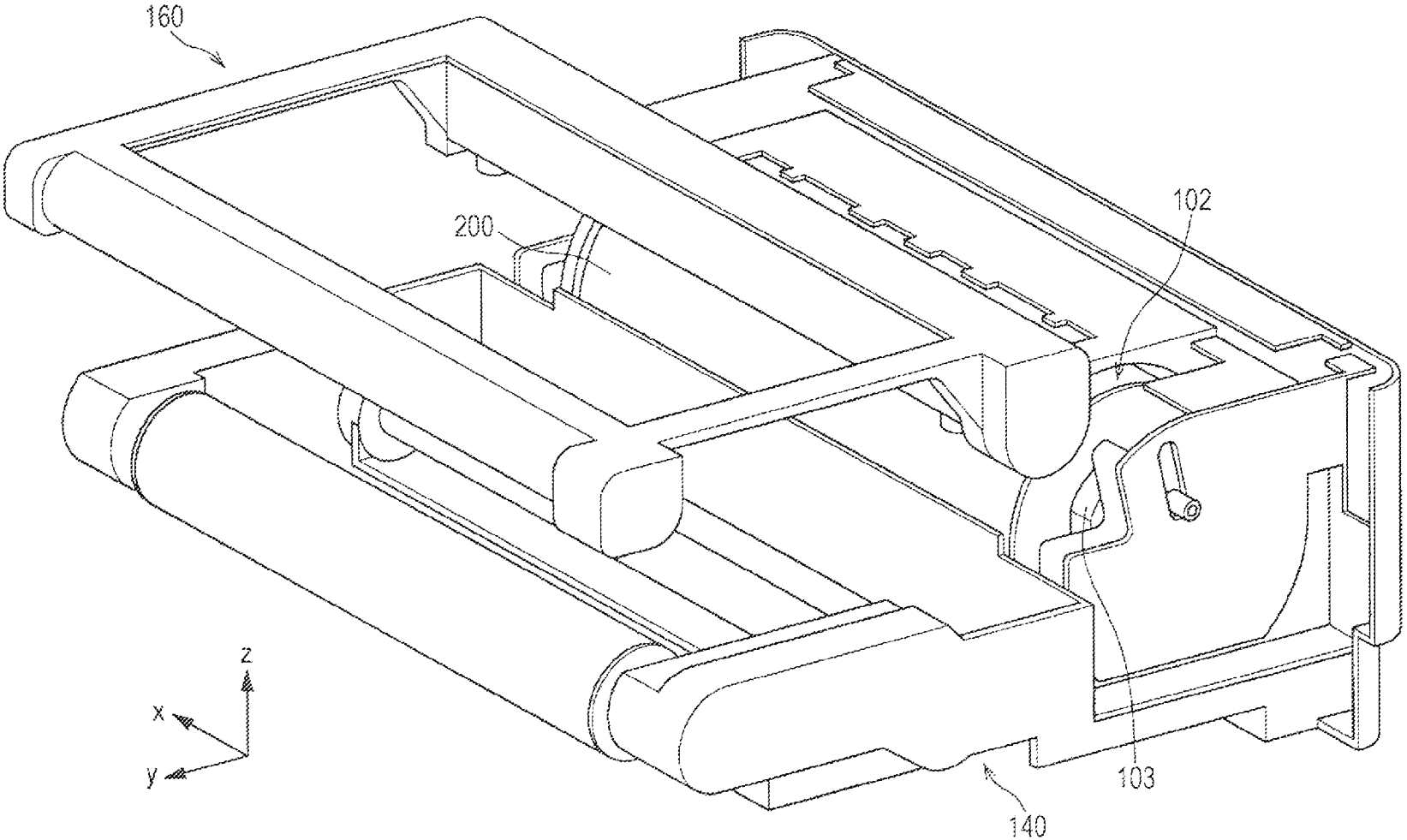
FIG. 8 is a schematic perspective view showing an arrangement relationship between the surface property modifying sheet cartridge and a ribbon tray according to the embodiment.
Figure 9:
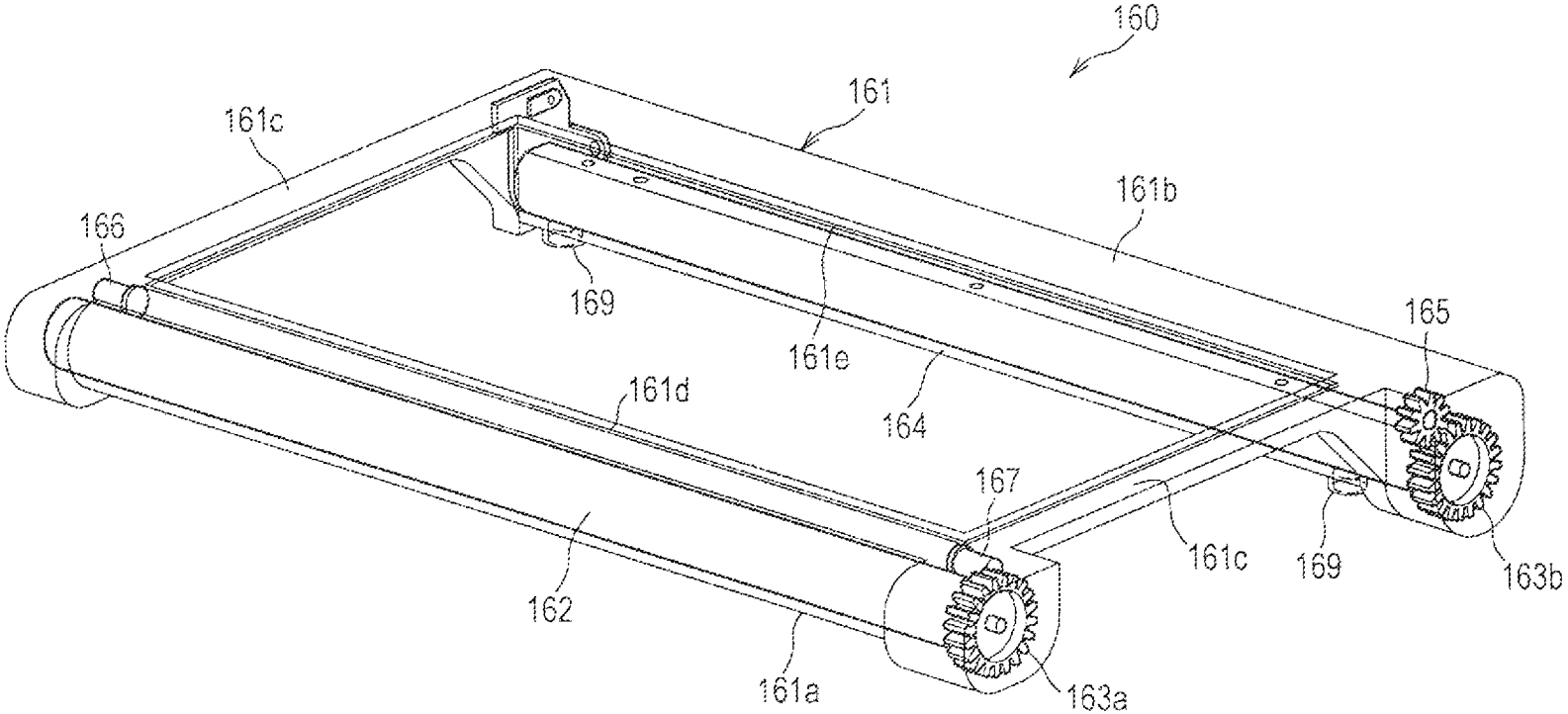
FIG. 9 is a schematic perspective view showing the configuration of the surface property modifying sheet cartridge according to the embodiment.
Figure 10:
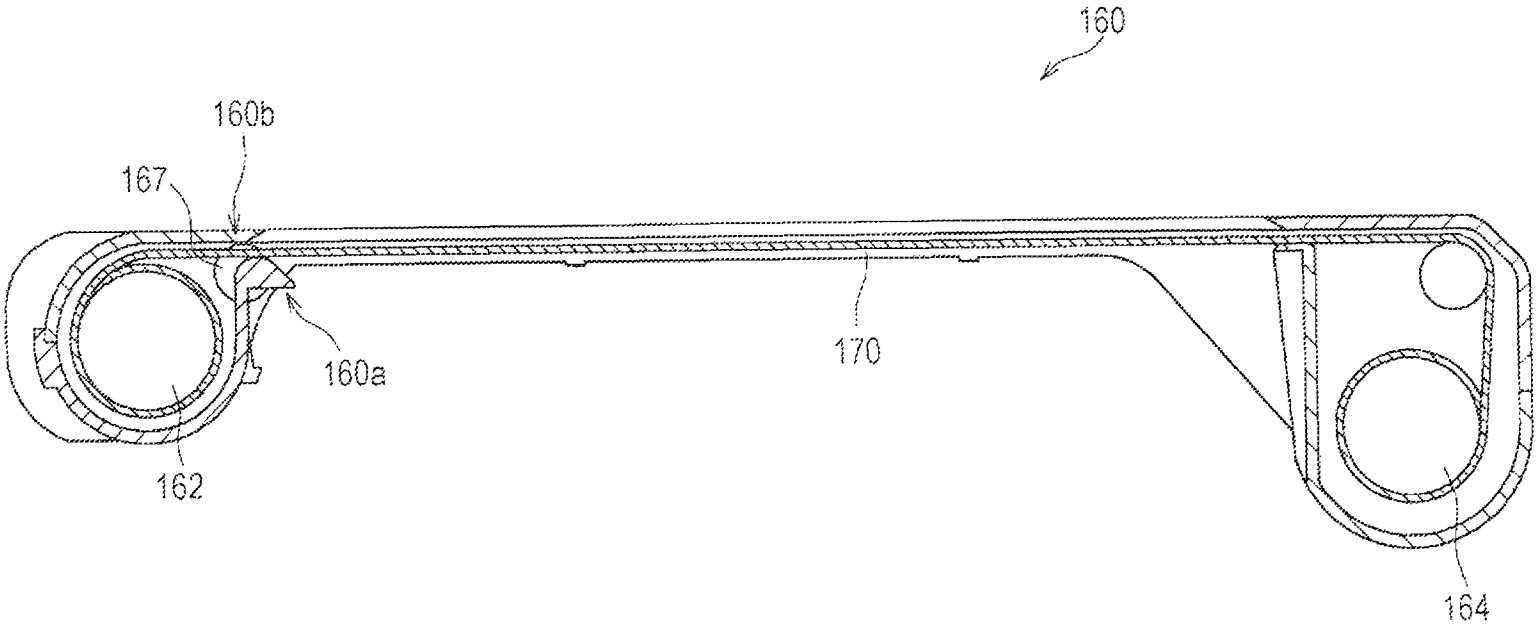
FIG. 10 is a schematic sectional view showing the configuration of the surface property modifying sheet cartridge according to the embodiment.
Figure 11:
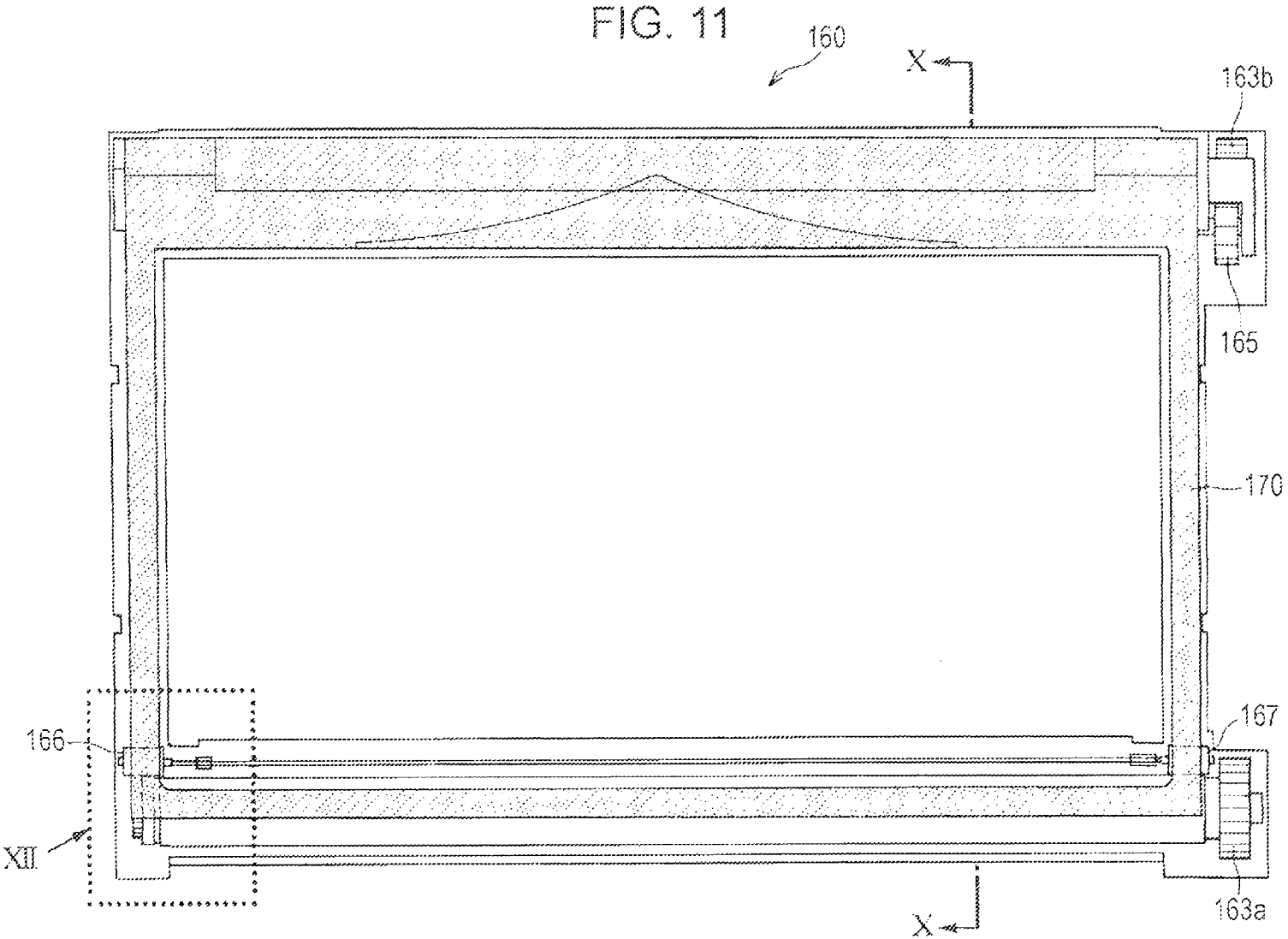
FIG. 11 is a schematic plan view showing the configuration of the surface property modifying sheet cartridge according to the embodiment.
Figure 12:
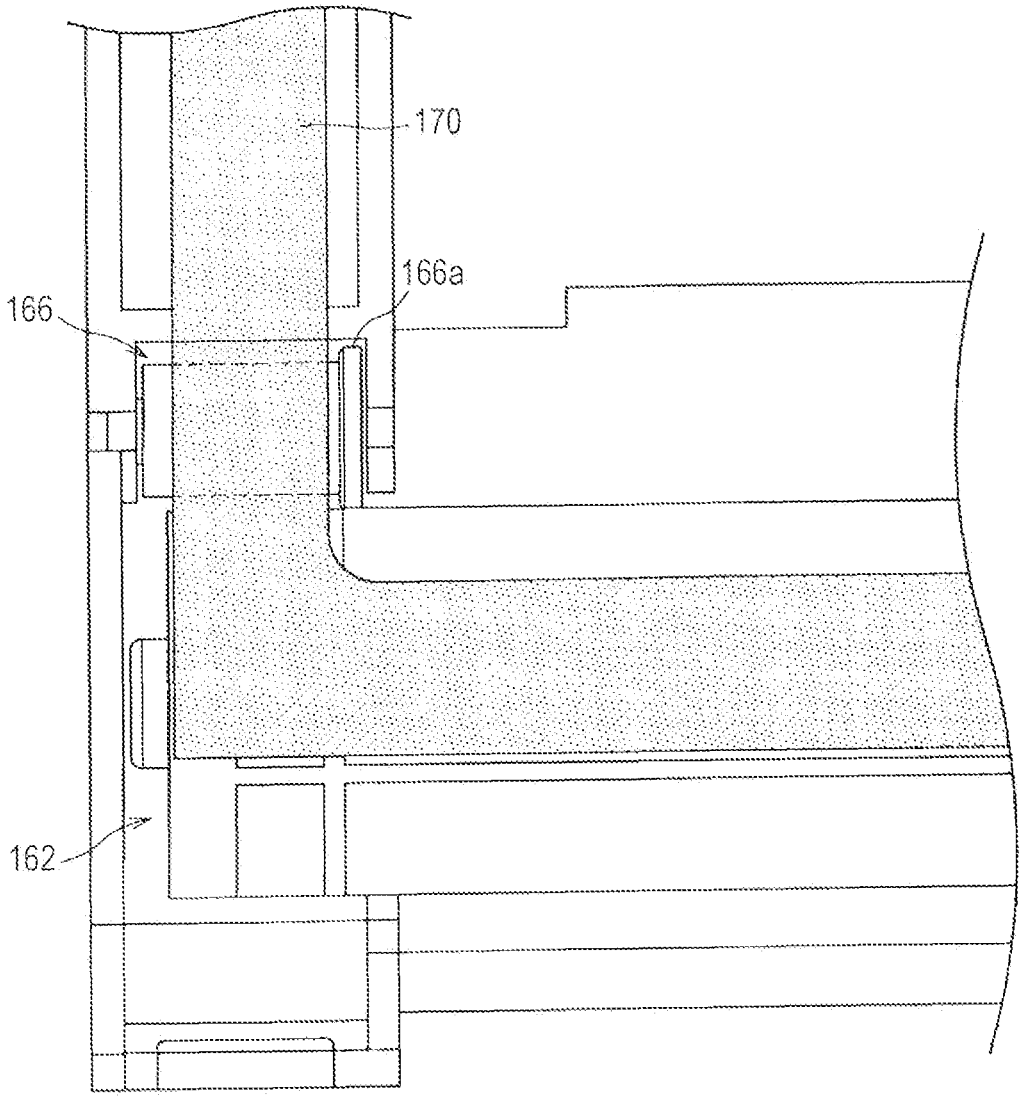
FIG. 12 is a partially enlarged view of a region XII of FIG. 11.
Figure 13:
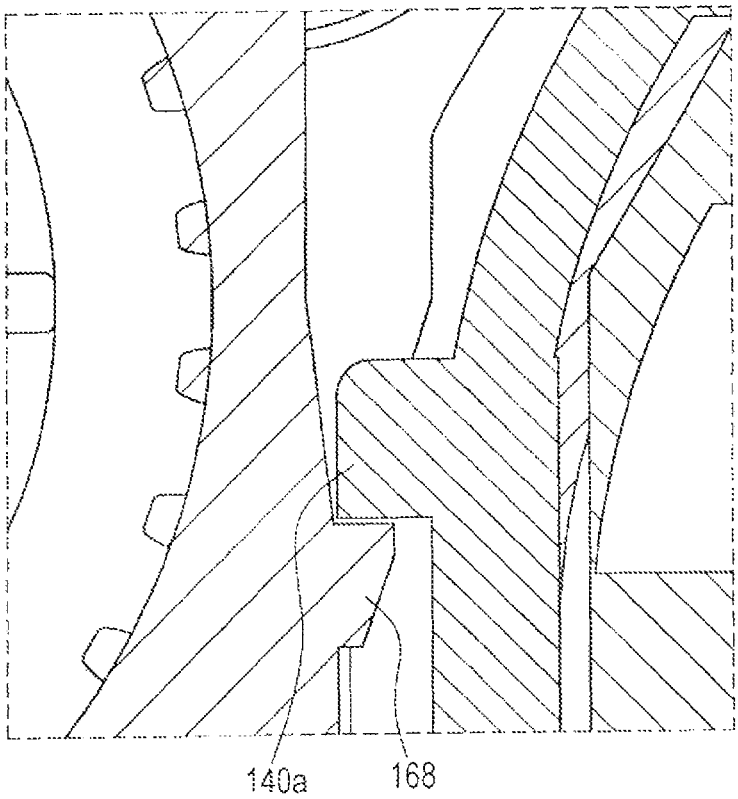
FIG. 13 is a partially enlarged view of a region XIII of FIG. 7.
Figure 14:
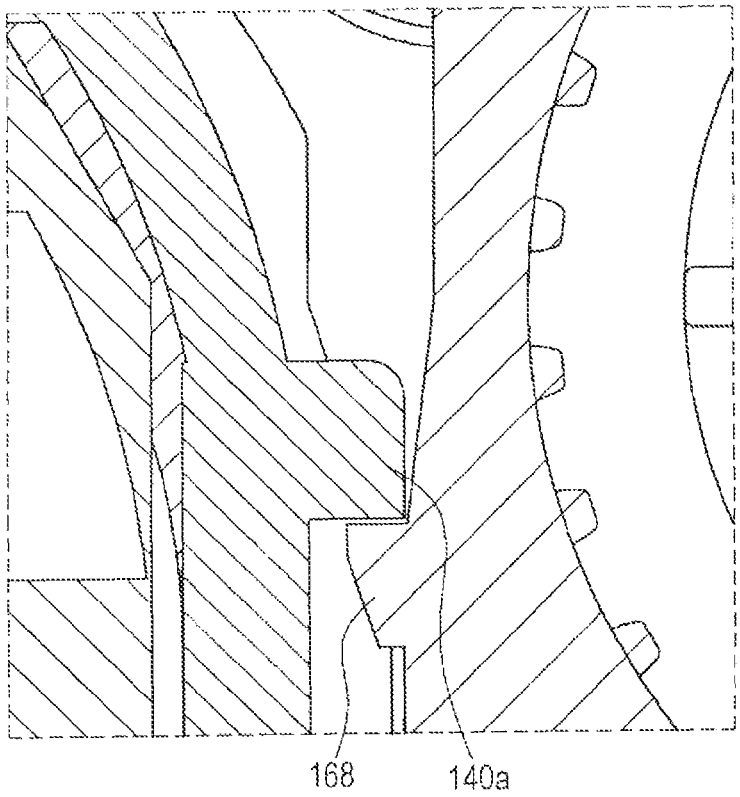
FIG. 14 is a partially enlarged view of a region XIV of FIG. 7.
Figure 15A:
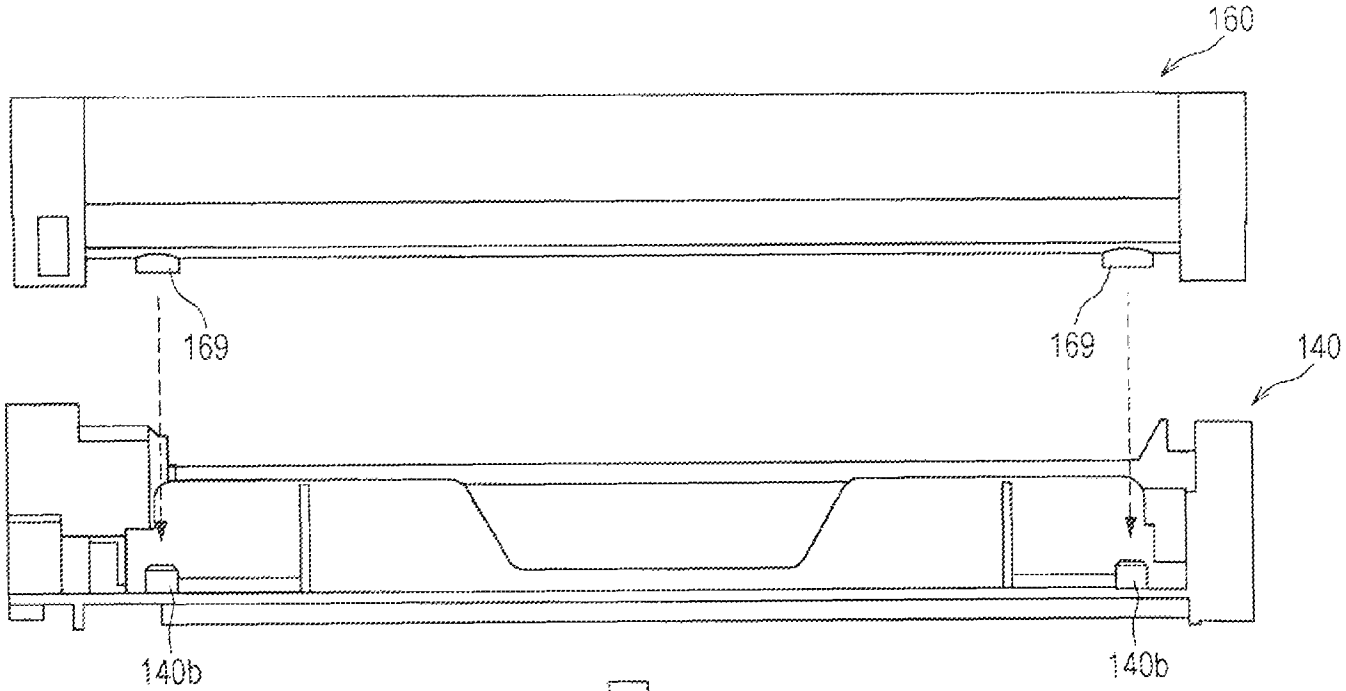
FIGS. 15A and 15B are a rear view showing a connecting relationship of the surface property modifying sheet cartridge and the ribbon tray according to the embodiment.
Figure 15B:
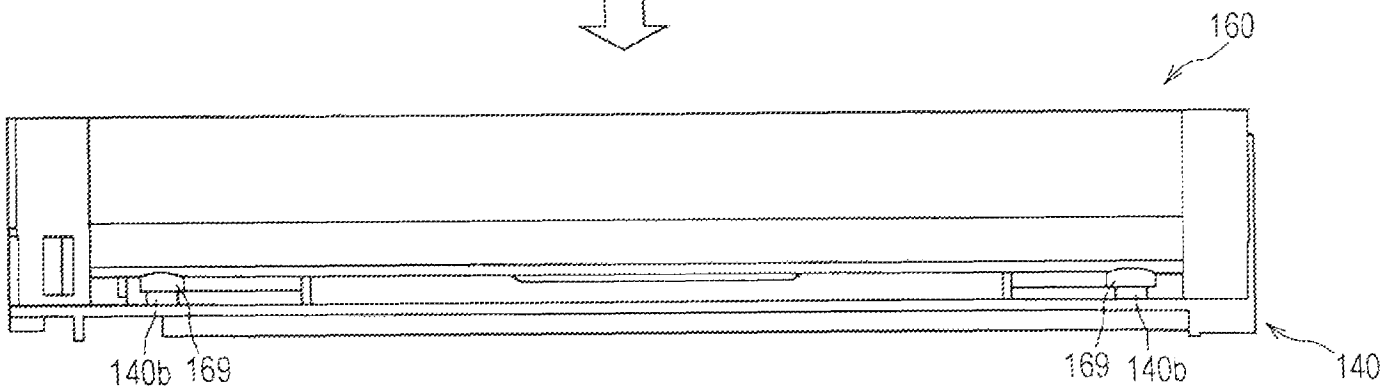

The configuration of the surface property modifying sheet cartridge 160 which stores the surface property modifying sheet 170 described above is described in more detail below. FIG. 8 is a schematic perspective view showing an arrangement relationship between the surface property modifying sheet cartridge 160 and a ribbon tray 140 according to the embodiment of the present technology. FIG. 9 is a schematic perspective view showing the configuration of the surface property modifying sheet cartridge 160 according to the embodiment. FIG. 10 is a schematic sectional view showing the configuration of the surface property modifying sheet cartridge 160 according to the embodiment. FIG. 11 is a schematic plan view showing the configuration of the surface property modifying sheet cartridge 160 according to the embodiment. FIG. 12 is a partially enlarged view of a region XII of FIG. 11. FIG. 13 is a partially enlarged view of a region XIII of FIG. 7. FIG. 14 is a partially enlarged view of a region XIV of FIG. 7. FIGS. 15A and 15B are a rear view showing a connecting relationship between the surface property modifying sheet cartridge 160 and the ribbon tray 140 according to the embodiment.

[Configuration of Surface Property Modifying Sheet Cartridge]

The surface property modifying sheet 170 according to the embodiment is stored in a case 161 together with the winding reel 162 and the supply reel 164 so as to constitute the surface property modifying sheet cartridge 160. The surface property modifying sheet cartridge 160 is attached to the ribbon tray 140 which is provided to the image forming apparatus and stores the thermal transfer sheet 150 as shown in FIG. 8. When the surface property modifying sheet cartridge 160 is attached to the ribbon tray 140, the supply reel 142 and the winding reel 144 supporting the thermal transfer sheet 150 are interposed between the winding reel 162 and the supply reel 164 supporting the surface property modifying sheet 170, as shown in FIG. 6.

The case 161 of the surface property modifying sheet cartridge 160 is composed of a first part 161*a* which has a cylindrical shape and covers the winding reel 162, a second part 161*b* which has a cylindrical shape and covers the supply reel 164, and two pieces of connecting parts 161*c* which connect both ends of the first part 161*a* and the second part 161*b*, as shown in FIG. 9. In the first part 161*a*, the winding reel 162 to which one end of the second leader sheet 171*b* of the surface property modifying sheet 170 is fixed is stored. To the winding reel 162, a torque limiter 163*a* for generating tension is provided. Further, regulation members 166 and 167 which regulate the position of the surface property modifying sheet 170 which is supplied from the winding reel 162 are provided on connecting parts between the first part 161*a* and the connecting parts 161*c*.

In the second part 161*b*, the supply reel 164 to which an end of the first leader sheet 171*a* of the surface property modifying sheet 170 is fixed is stored. To the supply reel 164 as well, a torque limiter 163*b* is provided as is the case with the winding reel 162. Further, on a surface, which is opposed to the ribbon tray 140, of the second part 161*b*, positioning members 169 for arranging respective reels 142, 144, 162, and 164 in parallel are provided.

The two pieces of connecting parts 161*c* connecting the both ends of the first part 161*a* and the second part 161*b* support the side parts of the surface property modifying sheet 170. Accordingly, a state that the surface property modifying sheet 170 is stretched is more easily maintained. Further, only the both ends of the first part 161*a* and the second part 161*b* are connected by the connecting parts 161*c*, and accordingly, an opening part is formed by the first part 161*a*, the second part 161*b*, and the two pieces of connecting parts 161*c*. On an inner circumferential surface of the opening part of the case 161, an entering/leaving gap is formed so that the surface property modifying sheet 170 can run therethrough.

The entering/leaving gap is composed of a gap 161*d* of the first part, a gap 161*e* of the second part, and gaps of the respective connecting parts 161*c*. It is sufficient for the entering/leaving gap to be bigger than the thickness of the surface property modifying sheet 170 to such an extent that the surface property modifying sheet 170 can run therethrough. Further, the shape of an entering/leaving part at the entering/leaving gap may be enlarged so as to more easily pull the surface property modifying sheet 170 into the inside of the case 161. For example, as shown in FIG. 10, sectional shapes of entering/leaving parts 160*a* and 160*b* of the entering/leaving gap 161*d* of the first part 161*a* are set to be slanted so as to enlarge the running path of the surface property modifying sheet 170. Accordingly, the surface property modifying sheet 170 can be smoothly run.

The property modifying sheet 174 of the surface property modifying sheet 170 is exposed at the opening part and is sandwiched by the thermal head 110 and the platen roller 120 together with the recording paper 200 and the thermal transfer sheet 150, being able to modify a surface condition of an image. When an image is formed on the recording paper 200 by using the thermal transfer sheet 150, the opening part 172 of the surface property modifying sheet 170 is positioned on the opening part of the case 161 as shown in FIG. 11. Accordingly, the thermal head 110 can be prevented from contacting with the surface property modifying sheet 170.

(Regulation Member)

In the surface property modifying sheet cartridge 160, the leader sheet 171*b* is wound around the winding reel 162 in at least one or more turn so as to prevent the surface property modifying sheet 170 (especially, the side parts 172*a* of the opening part 172) from shifting inward as described above. Further, on the connecting positions of the first part 161*a* and the connecting parts 161*c* of the case 161, the regulation members 166 and 167 are provided. When the region XII of FIG. 11 is enlarged, the regulation member 166 is composed of a cylindrical member provided with a flange part 166*a* as shown in FIG. 12.

The flange part 166*a* of the regulation member 166 is provided on the opening part side of the case 161 so as to be abutted on the side part 172*a* of the opening part 172 of the surface property modifying sheet 170. Accordingly, inward shift can be regulated against a force that the surface property modifying sheet 170 shifts toward the opening part (inside), and thus parallelism of the side parts 172*a* of the opening part 172 of the surface property modifying sheet 170 can be maintained.

Here, as shown in FIG. 3, the width of a part of the second leader sheet 171*b* is larger than the width of the opening part 172. Accordingly, the second leader sheet 171*b* rides on the flange part 166*a* of the regulation member 166 on this part. On the other hand, the widths of the first leader sheet 171*a* and the property modifying sheet 174 are smaller than the width of the opening part 172, so that the flange part 166*a* of the regulation member 166 is positioned on the outside of each of the sheets 171*b* and 174. In the embodiment, the regulation member 166 is formed to have a roller shape with a flange by which a lower load is imposed during an operation. However, embodiments of the present technology are not limited to this example.

(Fixing Member)

The surface property modifying sheet cartridge 160 is used in a manner to be attached to the ribbon tray 140 provided to a media tray which is a printing mechanism part, as shown in FIGS. 6 and 7. When the image forming apparatus is booted in the surface property modifying processing or the like, parallelism of the supply reel 142 and the winding reel 144 for the thermal transfer sheet 150, and the winding reel 162 and the supply reel 164 for the surface property modifying sheet 170 may be altered due to a driving force for driving respective members. Accordingly, a fixing member for fixing attachment positions when the ribbon tray 140 and the surface property modifying sheet cartridge 160 of the image forming apparatus according to the embodiment are attached to each other is provided to the surface property modifying sheet cartridge 160.

In the embodiment, fixing members are respectively provided to the region XIII and the region XIV of FIG. 7. That is, when the surface property modifying sheet cartridge 160 is attached to the ribbon tray 140, a protrusion part 140*a* of the ribbon tray 140 is engaged with a fixing member 168 provided to the second part 161*b* of the case 161 in the region XIII as shown in FIG. 13. In the region XIV, the protrusion part 140*a* of the ribbon tray 140 is engaged with a fixing member (engagement part) 168 provided to the first part 161*a* of the case 161 as shown in FIG. 14.

If such locking mechanism is easily unlocked in detaching the surface property modifying sheet cartridge 160, attachment and detachment of the surface property modifying sheet cartridge 160 become easy. Accordingly, in the embodiment, the fixing member 168 having a claw shape is provided to the surface property modifying sheet cartridge 160 as shown in FIGS. 13 and 14, and the surface property modifying sheet cartridge 160 is fixed to the ribbon tray 140 by using the engagement of the claw and the protrusion part 140*a* of the ribbon tray 140. However, embodiments of the present technology are not limited to this example, and the surface property modifying sheet cartridge 160 may be fixed to the ribbon tray 140 by other locking mechanisms.

(Positioning Member)

To the surface property modifying sheet cartridge 160 of the embodiment, the positioning members 169 for arranging the supply reel 142 and the winding reel 144 for the thermal transfer sheet 150, and the winding reel 162 and the supply reel 164 for the surface property modifying sheet 170 in parallel are provided. The positioning members 169 are formed on positions, which are opposed to the ribbon tray 140, of the second part 161*b* of the case 161 as shown in FIG. 9. The positioning member 169 is a cylindrical-shaped member, and a fitting part 140*b* which is provided to the ribbon tray 140 and protruded perpendicularly upward is fitted in the inside of the positioning member 169. That is, the positioning members 169 and the fitting parts 140*b* are formed on positions at which the respective reels 142, 144, 162, and 164 are arranged in parallel when the positioning members 169 and the fitting parts 140*b* are fitted to each other.

For example, as shown in FIGS. 15A and 15B, two positioning members 169 are provided on both end parts of the second part 161*b* of the case 161 and two fitting parts 140*b* are provided on positions respectively corresponding to the positioning members 169 (FIG. 15A). When the surface property modifying sheet cartridge 160 is attached to the ribbon tray 140, the positioning members 169 and the fitting parts 140*b* are respectively fitted to each other, regulating the position of the surface property modifying sheet cartridge 160 (FIG. 15B).

In the embodiment, two positioning members 169 are provided as shown in FIGS. 15A and 15B. However, embodiments of the present technology are not limited to this example, and three or more pieces of positioning members may be provided. Further, the positioning mechanism composed of the positioning members is not limited to this example, but the reels may be positioned by other mechanism in embodiments of the present technology. Furthermore, the reels are positioned by the surface property modifying sheet cartridge 160 and the ribbon tray 140 in the embodiment, but embodiments of the present technology are not limited to this example. For example, if fitting parts corresponding to the positioning members 169 of the surface property modifying sheet cartridge 160 are provided to the image forming apparatus body, the reels can be more accurately positioned.

The configuration of the image forming apparatus according to the embodiment and the configurations of the surface property modifying sheet cartridge 160 and the surface property modifying sheet 170 which are provided to the image forming apparatus are described above. The image forming apparatus according to the embodiment can make a surface condition of a printing object which is formed be various surface finish conditions such as glossy finish and matte-tone finish through the surface property modifying processing. The surface property modifying sheet cartridge 160 performing the surface property modifying processing is detachably provided to the image forming apparatus and is driven by a driving mechanism which is provided outside the cartridge. Accordingly, the surface property modifying sheet cartridge 160 can be easily detached from the image forming apparatus body, being able to improve a handling property.

By forming the surface property modifying sheet 170 in a cartridge shape which is detachable from the image forming apparatus body, small-sizing of the apparatus can be realized and maintenance associated with deterioration caused by multiple-time use of the surface property modifying sheet 170 can be easily performed. In a case of exchanging into a surface property modifying sheet provided with a different surface property modifying part for obtaining other surface properties, the exchange can be easily performed at low cost.

The preferred embodiment of the present technology has been described in detail with reference to the accompanying drawings, but embodiments of the present technology are not limited to the above example. It should be understood by those skilled in the art of the present technology that various modifications and alterations may occur within the technical scope of the embodiment of the present technology and it should be interpreted that these modifications and alterations are apparently within the scope of the present technology.

For example, in the above described embodiment, the surface property modifying sheet 170 is provided only with a sheet for glossy finish as the property modifying sheet 174 which is the surface property modifying part, but embodiments of the present technology are not limited to this example. Surface property modifying parts for matte-tone finish, silky finish, and the like, for example, may be provided in addition to the surface property modifying part for glossy finish. Of course, surface property modifying parts for other finish may be provided, and kinds, numbers, an arrangement, and the like of these parts are not specifically limited. Further, in a case where a plurality of surface property modifying parts are provided to the surface property modifying sheet 170, surface property modifying parts for respective kinds of finish may be singly provided to the surface property modifying sheet 170, or a plurality of surface property modifying parts may be provided in a case where using frequency of the surface property modifying parts is high. Thus, the number of the surface property modifying parts may be adequately set.

The image forming apparatus according to the embodiment of the present technology is a sublimation type image forming apparatus, but embodiments of the present technology are not limited to this example. For example, the present technology is applicable to a melt transfer type thermal printer, a thermo-sensitive type thermal printer which performs recording with respect to a recording paper without using a thermal transfer sheet, and the like.

The present disclosure contains subject matter related to that disclosed in Japanese Priority Patent Application JP 2010-185071 filed in the Japan Patent Office on Aug. 20, 2010, the entire contents of which are hereby incorporated by reference.

What is claimed is:

1. A surface property modifying sheet cartridge, comprising:

two reels that are disposed in parallel with a predetermined interval;

a surface property modifying sheet that is provided in a tensioned state between the two reels in a manner such that end parts thereof are respectively fixed to the two reels and are wound respectively around the two reels; and a case part configured to store the two reels and the surface property modifying sheet, wherein the case part includes a penetrating part that exposes a part of the surface property modifying sheet positioned between the two reels, wherein the surface property modifying sheet includes a surface property modifying part that is heated and pressed by a thermal head in surface property modifying processing, a first intermediate part connecting one of the end parts fixed to one of the reels and one end of the surface property modifying part, and a second intermediate part connecting the other of the end parts fixed to the other of the reels and the other end of the surface property modifying part, a rectangular opening part through which the thermal head passes in printing is formed on one of the first intermediate part and the second intermediate part, and at least one side, the side being approximately orthogonal to a running direction of the surface property modifying sheet, of the opening part has a shape protruding in the running direction toward an outside of the opening part.

2. The surface property modifying sheet cartridge according to claim 1, wherein detection holes, by which a conveying state of the surface property modifying sheet is detected, are respectively formed on the first intermediate part and the second intermediate part.

3. The surface property modifying sheet cartridge according to claim 2, wherein each of the detection holes has a shape protruding in the running direction of the surface property modifying sheet.

4. The surface property modifying sheet cartridge according to claim 1, wherein one of the first intermediate part and the second intermediate part on which the opening part is formed is wound around one of the reels in a length at least equal to or more than a circumferential length of the reel, in either running state.

5. The surface property modifying sheet cartridge according to claim 1, wherein the surface property modifying part is made of a material different from a material of the first intermediate part and the second intermediate part.

6. The surface property modifying sheet cartridge according to claim 5, wherein the surface property modifying part is made of polyimide, and the first intermediate part and the second intermediate part are made of polyethylene terephthalate.

7. The surface property modifying sheet cartridge according to claim 1, wherein the surface property modifying part has an approximately same thickness as a thickness of the first intermediate part and the second intermediate part.

8. The surface property modifying sheet cartridge according to claim 7, wherein a thickness of a connecting part on which the surface property modifying part and the first intermediate part are connected with each other, and a thickness of a connecting part on which the surface property modifying part and the second intermediate part are connected with each other, are same as a thickness of a part of the surface property modifying part, the first intermediate part, and the second intermediate part other than the connecting parts.

9. An image forming cartridge, comprising:

a thermal transfer sheet cartridge, including two reels that are disposed in parallel with a predetermined interval, a thermal transfer sheet that is provided in a tensioned state between the two reels in a manner such that end parts thereof are respectively fixed to the two reels and are wound respectively around the two reels, and includes a plurality of dye layer regions and protective material layer regions, and a case part configured to store the two reels and the thermal transfer sheet; and a surface property modifying sheet cartridge, including two reels that are disposed in parallel with a predetermined interval, a surface property modifying sheet that is provided in a tensioned state between the two reels in a manner such that end parts thereof are respectively fixed to the two reels and are wound respectively around the two reels, and a case part configured to store the two reels and the surface property modifying sheet, wherein the thermal transfer sheet cartridge and the surface property modifying sheet cartridge are detachably provided to each other.

10. The image forming cartridge according to claim 9, wherein the two reels of the thermal transfer sheet cartridge and the two reels of the surface property modifying sheet cartridge are provided approximately in parallel, and the surface property modifying sheet cartridge is provided to the thermal transfer sheet cartridge so that the two reels of the thermal transfer sheet cartridge are interposed between the two reels of the surface property modifying sheet cartridge.

11. The image forming cartridge according to claim 9, wherein the case part of the surface property modifying sheet cartridge includes an engagement part that is engaged with a protrusion part, the protrusion part being provided to a printing mechanism including the thermal transfer sheet cartridge, when the surface property modifying sheet cartridge is attached to the printing mechanism.

12. The image forming cartridge according to claim 9, wherein the case part of the surface property modifying sheet cartridge includes a positioning part that is fitted to a fitting part, the fitting part being provided to the printing mechanism including the thermal transfer sheet cartridge, when the surface property modifying sheet cartridge is attached to the printing mechanism.

* * * * *